US008324493B2

(12) United States Patent
Okuda

(10) Patent No.: US 8,324,493 B2
(45) Date of Patent: Dec. 4, 2012

(54) ELECTRONIC MUSICAL INSTRUMENT AND RECORDING MEDIUM

(75) Inventor: Hiroko Okuda, Kokubunji (JP)

(73) Assignee: Casio Computer Co., Ltd, Tokyo (JP)

( * ) Notice: Subject to any disclaimer, the term of this patent is extended or adjusted under 35 U.S.C. 154(b) by 171 days.

(21) Appl. No.: 13/012,088

(22) Filed: Jan. 24, 2011

(65) Prior Publication Data

US 2011/0185882 A1 Aug. 4, 2011

(30) Foreign Application Priority Data

Feb. 4, 2010 (JP) ..... 2010-22736

(51) Int. Cl.
*G10H 1/00* (2006.01)
*G10H 1/18* (2006.01)
*G10H 7/00* (2006.01)

(52) U.S. Cl. ..... 84/615; 84/653; 84/454

(58) Field of Classification Search ..... 84/615, 84/653, 454
See application file for complete search history.

(56) References Cited

U.S. PATENT DOCUMENTS 4,947,724 A * 8/1990 Hirano et al. ..... 84/631
5,117,727 A * 6/1992 Matsuda ..... 84/619
5,501,130 A * 3/1996 Gannon et al. ..... 84/454
5,525,749 A * 6/1996 Aoki ..... 84/609
5,736,661 A * 4/1998 Armstrong ..... 84/454
7,504,574 B2 * 3/2009 Okamoto et al. ..... 84/615
7,880,078 B2 * 2/2011 Nishida ..... 84/615
8,022,284 B1 * 9/2011 Velez Medicis ..... 84/454

FOREIGN PATENT DOCUMENTS

JP 60-125893 7/1985
JP 60-126699 7/1985
JP 314357 2/1991
JP 314358 2/1991
JP 2009-186632 8/2009

OTHER PUBLICATIONS

Japanese Office Action for Japanese Application No. 2010-022736 mailed on Feb. 14, 2012.

* cited by examiner

*Primary Examiner* — Jeffrey Donels
(74) *Attorney, Agent, or Firm* — Turocy & Watson, LLP

(57) ABSTRACT

In response to depressing operation of a key in a melody key range 102 of a keyboard, CPU 21 decides a pitch of musical-tone data to be produced. Concerning the depressing operation on the melody key range 102, CPU 21 specifies a jins or a predetermined temperament from maqam data or temperament-type data based on depressed keys in an accompaniment key range 101 of the keyboard. Further, CPU 21 specifies a composing tone corresponding to the depressed key in the melody range, and gives a sound source 26 an instruction of generating musical-tone data having a pitch of the composing tone.

8 Claims, 24 Drawing Sheets

701

700

| MAQAM NO. | MAQAM NAME | FIRST JINS | | | SECOND JINS | | | THIRD JINS | | | FOURTH JINS | | | FIFTH JINS | | | SIXTH JINS | | |
|---|---|---|---|---|---|---|---|---|---|---|---|---|---|---|---|---|---|---|---|
| | | NAME | LOWEST TONE | U/D | NAME | LOWEST TONE | U/D | NAME | LOWEST TONE | U/D | NAME | LOWEST TONE | U/D | NAME | LOWEST TONE | U/D | NAME | LOWEST TONE | U/D |
| 1 | RAST | RAST | C | U | RAST | G | U | RAST | C | U | RAST | G | D | NAHAWAND | G | D | RAST | C | D |
| 2 | BAYATI | BAYATI | D | U | RAST | G | U | BAYATI | D | U | BAYATI | D | D | NAHAWAND | G | D | BAYATI | D | D |
| 3 | SIKAH | SIKAH2 | $E^{\flat}$ ↑ | U | RAST | G | U | RAST | C | U | SIKAH2 | C | D | NAHAWAND | G | D | SIKAH2 | $E^{\flat}$ ↑ | D |
| 4 | HUZAM | SIKAH2 | $E^{\flat}$ ↑ | U | HIJAZ1 | G | U | RAST | C | U | SIKAH2 | C | D | NAHAWAND | G | D | SIKAH2 | $E^{\flat}$ ↑ | D |
| | | | | | | | | | | | | | | | | | | | |

FIG. 6

600

| JINS NO | JINS NAME | LOWEST TONE | 1–2 | 2–3 | 3–4 | 4–5 | TOTAL | JINS SORT |
|---|---|---|---|---|---|---|---|---|
| 1 | Rast | C | 200 | 150 | 150 | – | 500 | TETRA CHORD |
| 2 | Nahawand | G | 200 | 100 | 200 | – | 500 | TETRA CHORD |
| 3 | Saba | D | 150 | 150 | 100 | – | 400 | TETRA CHORD |
| 4 | Bayati | D | 150 | 150 | 200 | – | 500 | TETRA CHORD |
| 5 | Sikah1 | C | 200 | 150 | – | – | 350 | TRI CHORD |
| 6 | Sikah2 | C | 150 | 200 | – | – | 350 | TRI CHORD |
| 7 | Hijaz1 | D | 100 | 300 | 100 | – | 500 | TETRA CHORD |
| 8 | Hijaz2 | D | 50 | 350 | 100 | – | 500 | TETRA CHORD |
| ⋮ | ⋮ | ⋮ | ⋮ | ⋮ | ⋮ | ⋮ | ⋮ | ⋮ |

601

602

603

611

FIG. 7

701

700

| MAQAM NO. | MAQAM NAME | FIRST JINS | | | SECOND JINS | | | THIRD JINS | | | FOURTH JINS | | | FIFTH JINS | | | SIXTH JINS | | |
|---|---|---|---|---|---|---|---|---|---|---|---|---|---|---|---|---|---|---|---|
| | | NAME | LOWEST TONE | U/D | NAME | LOWEST TONE | U/D | NAME | LOWEST TONE | U/D | NAME | LOWEST TONE | U/D | NAME | LOWEST TONE | U/D | NAME | LOWEST TONE | U/D |
| 1 | RAST | RAST | C | U | RAST | G | U | RAST | C | U | RAST | G | D | NAHAWAND | G | D | RAST | C | D |
| 2 | BAYATI | BAYATI | D | U | RAST | G | U | BAYATI | D | U | BAYATI | D | D | NAHAWAND | G | D | BAYATI | D | D |
| 3 | SIKAH | SIKAH2 | $E^{\flat}$ ↑ | U | RAST | G | U | RAST | C | U | SIKAH2 | C | D | NAHAWAND | G | D | SIKAH2 | $E^{\flat}$ ↑ | D |
| 4 | HUZAM | SIKAH2 | $E^{\flat}$ ↑ | U | HIJAZ1 | G | U | RAST | C | U | SIKAH2 | C | D | NAHAWAND | G | D | SIKAH2 | $E^{\flat}$ ↑ | D |
| | | | | | | | | | | | | | | | | | | | |

FIG. 10

1000

| | RHYTHM NO. | RHYTHM NAME | JAPANESE | MELODY TIMBRE | CHORD TIMBRE | TEMPO | MAQAM NO. | ACCOMPANIMENT PATTERN | ..... |
|---|---|---|---|---|---|---|---|---|---|
| AMERICA | ⋮ | ⋮ | ⋮ | ⋮ | ⋮ | ⋮ | ⋮ | ⋮ | ..... |
| | 113 | DIXIE | デキシー | 11 | 417 | 163 | – | 10 | ..... |
| | 114 | TEX-MEX | テックスメックス | 89 | 93 | 120 | – | 10 | ..... |
| | ⋮ | ⋮ | ⋮ | ⋮ | ⋮ | ⋮ | ⋮ | ⋮ | ..... |
| ARABIC/ ORIENTAL | 128 | ADANI | アダニ | 100 | 343 | 90 | 1 | 101 | ..... |
| | 129 | BALADI | バラディ | 252 | 93 | 97 | 2 | 102 | ..... |
| | ⋮ | ⋮ | ⋮ | ⋮ | ⋮ | ⋮ | ⋮ | ⋮ | ..... |
| INDIA | 132 | BHANGRA | バングラ | 498 | 59 | 90 | – | 91 | ..... |
| | 133 | DADRA | ダードラー | 391 | 470 | 90 | – | 91 | ..... |
| | 134 | GARBA | ガルバ | 395 | 471 | 110 | – | 92 | ..... |
| | ⋮ | ⋮ | ⋮ | ⋮ | ⋮ | ⋮ | ⋮ | ⋮ | ..... |
| ⋮ | ⋮ | ⋮ | ⋮ | ⋮ | ⋮ | ⋮ | ⋮ | ⋮ | ⋮ |

1001

1002

FIG. 15

1500

| JINS NO. | NAME | LOWEST TONE | 1–2 | 2–3 | 3–4 | 4–5 | TOTAL | JINS SORT |
|---|---|---|---|---|---|---|---|---|
| 1 | Rast | C | 200 | 150 | 150 | – | 500 | TETRA CHORD |
| 2 | Nahawand | G | 200 | 100 | 200 | – | 500 | TETRA CHORD |
| 3 | Saba | D | 150 | 150 | 100 | – | 400 | TETRA CHORD |
| 4 | Bayati | D | 150 | 150 | 200 | – | 500 | TETRA CHORD |
| 5 | Sikah1 | C | 200 | 150 | – | – | 350 | TRI CHORD |
| 6 | Sikah2 | C | 150 | 200 | – | – | 350 | TRI CHORD |
| 7 | Hijaz1 | D | 100 | 300 | 100 | – | 500 | TETRA CHORD |
| 8 | Hijaz2 | D | 50 | 350 | 100 | – | 500 | TETRA CHORD |
| ⋮ | ⋮ | ⋮ | ⋮ | ⋮ | ⋮ | ⋮ | ⋮ | ⋮ |
| USER 1 | R1 | C | 200 | 180 | 120 | – | 500 | TETRA CHORD |
| ⋮ | ⋮ | ⋮ | ⋮ | ⋮ | ⋮ | | ⋮ | ⋮ |

1501

ELECTRONIC MUSICAL INSTRUMENT AND RECORDING MEDIUM

CROSS REFERENCE OF RELATED APPLICATIONS

The present application is based upon and claims the benefit of priority from the prior Japanese Patent Application No. 2010-22736, file Feb. 4, 2010, and the entire contents of which are incorporated herein by reference.

BACKGROUND OF THE INVENTION

1. Field of the Invention

The present invention relates to an electronic musical instrument, which allows playing musical tones of pitches including so-called microtones and a recoding medium.

2. Description of the Related Art

Electronic musical instruments have been developed, which allow performance of Western music with simple operation. In general, Western music is added with chord tones with specific functions and is given patterns of percussion tones when appropriate, as a melody tone conforming to temperaments progresses on the basis of the temperaments. For example, an automatic accompaniment permits a player to simply depress keys to designate automatic accompaniment patterns for producing musical tones composing desired chord names depending on the number of depressed keys, thereby obtaining accompaniment effects by a band and/or an orchestra. The chord names are decided based on the number of depressed keys, and the root tone of the chord is decided based on the lowest tone of the depressed keys.

Meanwhile, in areas other than Western Europe, for example, in the Middle East, India and Asia, music conforming to temperament types different from Western music has been performed and enjoyed since ancient times. In the music other than Western music, the melody progresses in conformity with the temperament types and is given appropriate percussion tones. But in the music conforming to the temperament types different from Western music, since pitches are different from temperaments, there is a problem that it is not easy to play such music with a keyboard instrument.

For example, JP Hei3-14357 and JP Hei3-14358 propose electronic musical instruments, which set a musical scale other than a temperament scale and switches from the temperament scale to the preset musical scale, in response to a player's switching manipulation, and create musical tones of pitches conforming to the switched musical scale.

However, a temperament type, a so-called "Maqam" in the Middle East contains plural temperaments, so-called "ajnas" (plural "jins"). The jins contains a microtone substantially equivalent to ¼ tone in addition to pitches conforming to the temperament. In some jins, a musical tone should produce a tone of a pitch substantially conforming to the temperament, but there is a case where in other jins, the musical tone of the same pitch expressed on the five line staff should produce a tone of a pitch different by about ¼ tone. Therefore, it is actually impossible for conventional electronic musical instruments to produce the microtone appropriately.

SUMMARY OF THE INVENTION

The present invention has an object to provide an electronic musical instrument, which produces appropriate microtones as desired by a player, and allows the player to play music conforming to the temperament type of music other than Western music, and to provide a recording medium storing a computer program for producing musical tones.

According to one aspect of the invention, therein provided an electronic musical instrument, which comprises storing means for storing temperament data and temperament-type data, and musical-tone data generating means for generating musical-tone data of a predetermined pitch in response to player's manipulation on a manipulating device, wherein the temperament data defines a pitch of a temperament composed of plural composing tones and contains information indicating at least a reference tone of the temperament and pitches of the composing tones of the temperament, and the temperament-type data defines a temperament type composed of a combination of plural temperaments and contains information, which specifies the temperament data for each of the plural temperaments composing the temperament type in the order conforming to the temperament type, and the electronic musical instrument, wherein the manipulating device is divided into a first range and a second range and is provided with controlling means for deciding a pitch of a musical tone to be produced, in response to manipulation of a manipulator in the first range of the manipulating device, wherein the controlling means comprises temperament deciding means for specifying a temperament from among the temperament-type data based on manipulated manipulators in the second range of the manipulating device with respect to the manipulation of the manipulator in the first range of the manipulating device, and pitch deciding means for specifying a composing tone corresponding to the manipulated manipulator in the first range, from among the composing tones indicated in the temperament specified by the temperament deciding means, and for giving the musical-tone data generating means an instruction of generating musical-tone data having a pitch of the specified composing tone.

According to another aspect of the invention, there is provided a computer readable recording medium to be mounted on an electronic musical instrument, wherein the electronic musical instrument is provided with a computer, storing means for storing temperament data and temperament-type data, and musical-tone data generating means for generating musical-tone data of a predetermined pitch in response to player's manipulation on a manipulating device, which is divided into a first range and a second range, wherein the temperament data defines a pitch of a temperament composed of plural composing tones and contains information indicating at least a reference tone of the temperament and pitches of the composing tones of the temperament, and the temperament-type data defines a temperament type composed of a combination of plural temperaments and contains information, which specifies the temperament data for each of the plural temperaments composing the temperament type in the order conforming to the temperament type, the recording medium storing a musical-tone generating program, when executed, to make the computer perform the steps of controlling step of deciding a pitch of a musical tone to be produced, in response to manipulation of a manipulator in the first range of the manipulating device, wherein the controlling step comprises temperament deciding step of specifying a temperament from among the temperament-type data based on manipulated manipulators in the second range of the manipulating device with respect to the manipulation of the manipulator in the first range of the manipulating device, and pitch deciding step of specifying a composing tone corresponding to the manipulated manipulator in the first range, from among the composing tones indicated in the temperament specified by the temperament deciding means, and for giving the musical-tone data generating means an instruction of generating musical-tone data having a pitch of the specified composing tone.

BRIEF DESCRIPTION OF THE DRAWINGS

FIG. 5*a* is a view showing an example of temperaments of "Maqam Sikah" and FIG. 5*b* is a view showing an example of temperaments of "Maqam Huzam".

FIG. 6 is a view showing an example of a data structure of "jins" used in the electronic musical instrument according to the embodiment of the invention.

FIG. 7 is a view showing an example of a data structure of Maqam used in the electronic musical instrument according to the embodiment of the invention.

FIG. 10 is a view showing an example of a data structure of rhythm data used in the embodiment.

FIG. 15 is a view showing the data structure of "jins" with a new record added in RAM.

DETAILED DESCRIPTION OF THE PREFERRED EMBODIMENTS

Figure 1:
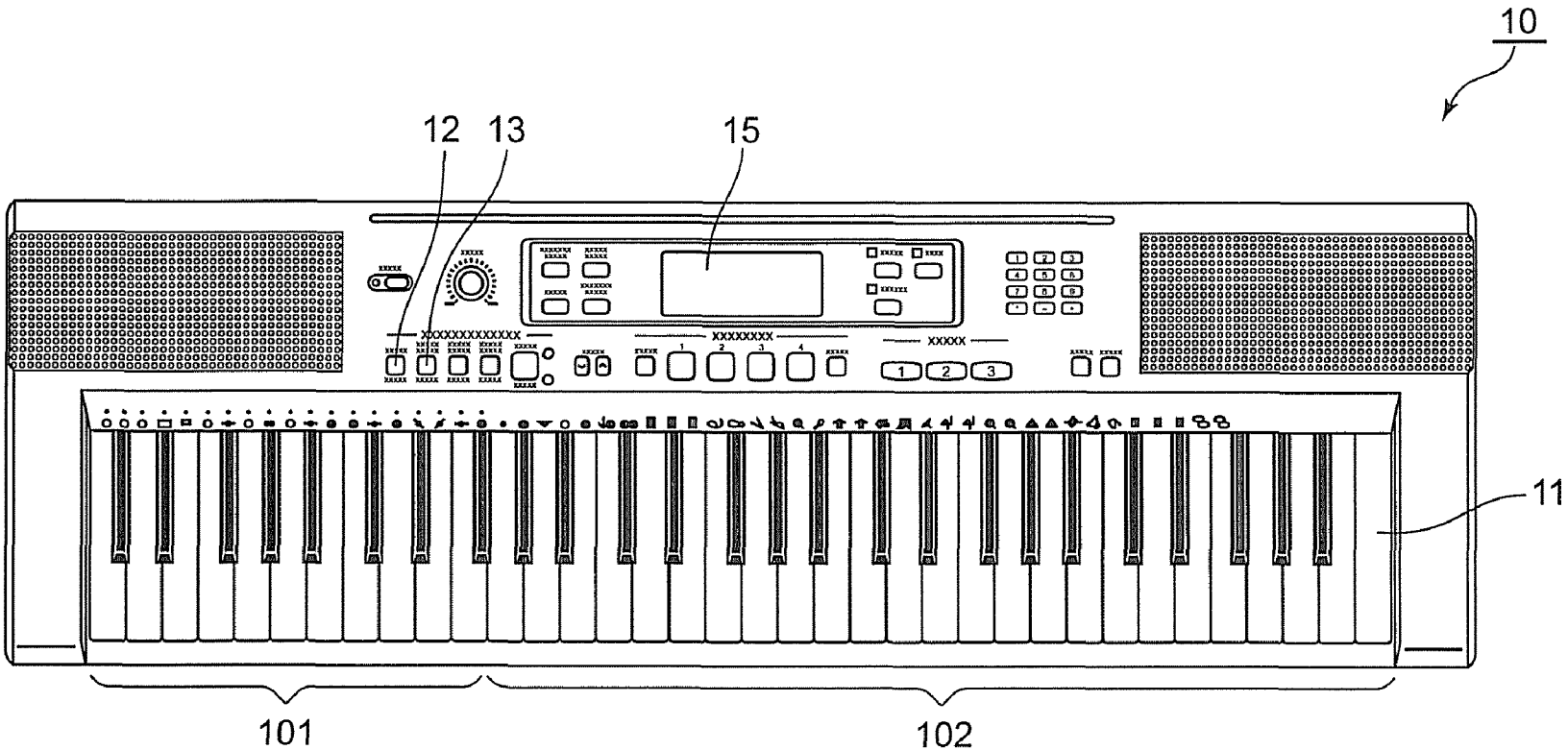
FIG. 1 is an external view showing an electronic musical instrument according to embodiments of the present invention.

Now, an electronic musical instrument according to embodiments of the invention will be described in detail with reference to the accompanying drawings. FIG. 1 is an external view showing the electronic musical instrument according to the embodiment of the present invention. As shown in FIG. 1, the electronic musical instrument 10 according to the present embodiment has a keyboard 11. On the upper side of the keyboard 11, there are provided switches (Reference numbers 12, 13) and a displaying unit 15. The switches are used to designate timbres, start/terminate of an automatic accompaniment, a rhythm pattern and so on. The displaying unit 15 displays information concerning a musical piece to be played, such as timbres, rhythm patterns, chord names and so on.

In the electronic musical instrument 10 according to the present embodiment, the switches and the displaying unit 15 are used to set and edit temperament patterns such as a tri-chord (three-note temperament), tetra-chord (four-note temperament) and penta-chord (five-note temperament). Further, the switches and the displaying unit 15 are also used to set and edit a maqam or a melody type including scales, which is composed of a combination of patterns defining the above temperaments.

The electronic musical instrument 10 according to the present embodiment has, for example, 61 keys (C2 to C7). The electronic musical instrument 10 allows the player to play music in either of two performance modes, one in an automatic accompaniment mode and other in a normal mode. In the automatic accompaniment mode, 18 keys form C2 to F3 (refer to Reference number: 101) are used as a keyboard for an accompaniment and 43 keys from F♯4 to C7 (refer to Reference number: 102) are used as a keyboard for a melody. A key range denoted by the reference number 101 is called an "accompaniment-key range" and a key range denoted by the reference number 102 is also called a "melody-key range".

Figure 2:
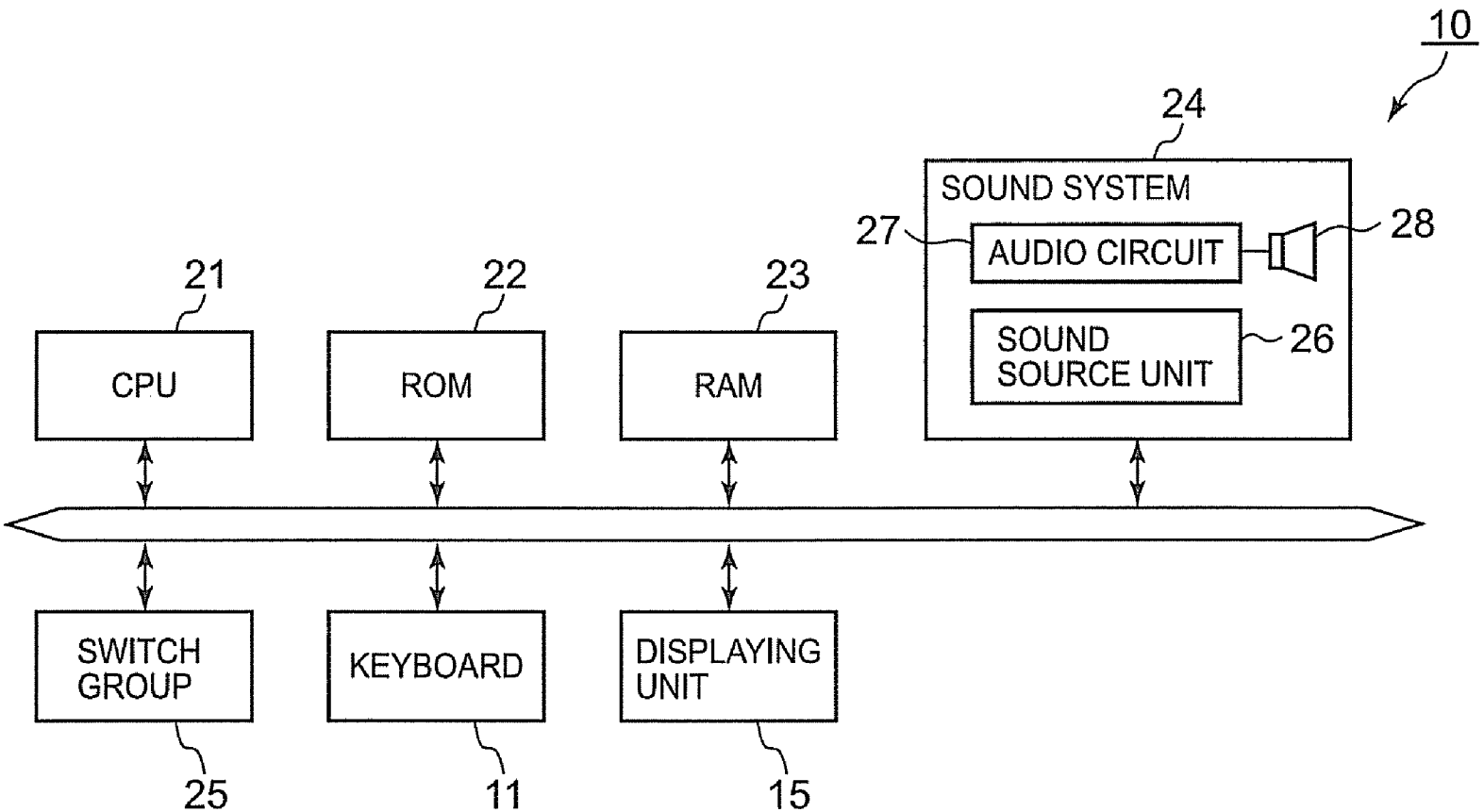
FIG. 2 is a block diagram showing a configuration of the electronic musical instrument according to the embodiment of the invention.

FIG. 2 is a block diagram showing a configuration of the electronic musical instrument 10 according to the present embodiment. As shown in FIG. 2, the electronic musical instrument 10 according to the present embodiment is provided with CPU 21, ROM 22, RAM 23, a sound system 24, a switch group 25, the keyboard 11 and the displaying unit 15.

CPU 21 serves to control whole operation of the electronic musical instrument 10 and to detect a manipulated state of keys of the keyboard 11 and also a manipulated state of the switches (for instance, refer to Reference numbers 12, 13 in FIG. 1). Further, CPU 21 serves to control the sound system 24 in accordance with the detected manipulated states of the keys and switches and to perform the automatic accompaniment in accordance with automatic accompaniment patterns.

ROM 22 stores a program for CPU 21 to perform various processes and tone-producing data of musical tones composing the automatic accompaniment patterns, wherein the processes include, for instance, the detecting process for detecting manipulated state of the switches and depressed keys of the keyboard 11 and a tone generating process for generating musical tones corresponding to the depressed keys. Further, ROM 22 has a waveform data area and an automatic accompaniment pattern area, wherein the waveform data area stores waveform data to be used to generate musical tones of piano, guitar, bass drum, snare drum and cymbal, and the automatic accompaniment pattern area stores data indicating various automatic accompaniment patterns. ROM 22 stores data of predetermined temperament patterns (tri-chord, tetra-chord and penta-chord) and data (melody-type data) of melody types (maqams) composed of the combined temperament patterns.

The automatic accompaniment data contains three sorts of musical tones; melody tones (including obbligato tones), chord tones and rhythm tones. A melody automatic accompaniment pattern is composed of the melody tones. A chord automatic accompaniment pattern is composed of the chord tones. A rhythm pattern is composed of rhythm tones.

RAM 23 serves to store the program read from ROM 22 and data produced during the course of the process. In the present embodiment, the automatic accompaniment pattern has melody automatic accompaniment patterns containing melody tones and obbligato tones, chord automatic accompaniment patterns containing chord tones, and rhythm patterns containing drum tones. For example, a record of data of the melody automatic accompaniment pattern contains timbre, a pitch, a tone producing timing, and a tone duration of each of musical tones. A record of data of the chord automatic accompaniment pattern contains data indicating chord names in addition to the above information. Data of the rhythm pattern contains timbre and a tone producing timing of each musical tone.

Further, in the present embodiment, the data of temperament pattern and the data of melody type can be edited, and the data of temperament pattern and the data of melody type edited by the player can be stored in RAM 23.

The sound system 24 comprises the sound source unit 26, audio circuit 27 and the speaker 28. Upon receipt of information concerning depressed keys and/or information concerning automatic accompaniment patterns from CPU 21, the sound source unit 26 reads appropriate waveform data from the waveform area of ROM 22 and generates and outputs musical data of a certain pitch. Further, the sound source unit 26 can also output as musical-tone data without any modification made thereto, waveform data and in particular waveform data of timbres of percussion instruments such as bass drums, snare drums and cymbals. The audio circuit 27 converts musical-tone data (digital data) into analog data. The analog data converted and amplified by the audio circuit 27 is output through the speaker 28 as an acoustic signal.

The electronic musical instrument 10 according to the present embodiment generates musical tones in response to key depressing operation on the keyboard 11 by the player or user in a normal mode. Meanwhile, when an automatic accompaniment switch (not shown) is operated, the electronic musical instrument 10 can be switched from the normal mode to the automatic accompaniment mode. In the automatic accompaniment mode, a key-depressing manipulation of a key in the melody-key range 102 produces a musical tone of a pitch corresponding to the depressed key. Further, a key-depressing manipulation of a key in the accompaniment-key range controls an automatic accompaniment pattern, producing musical tones in accordance with the controlled automatic accompaniment pattern. The automatic accompaniment pattern includes the melody automatic accompaniment pattern and chord automatic accompaniment pattern representing changes in pitch of piano and guitar, and rhythm pattern with no change in pitch of the bass drum, snare drum, and cymbal.

In the present embodiment, automatic accompaniment patterns using melody types of music other than Western music will be discussed. Hereinafter, in the present embodiment will be described the melody types of music other than Western music and the data of temperament pattern and the data of melody type stored in ROM 22.

In Western music, monophony music typically represented by Gregorian chants was played until the Middle Ages, and thereafter through polyphony music composed of polyphonic parts, music backed by harmony has become the mainstream at the present day. However, in the areas other than Europe and the United States, for example, in the Middle East, Asia and Africa, the monophony music is frequently played to this day. In the monophony music, it is general to change a monophony in accordance with fine temperaments.

Figure 3:
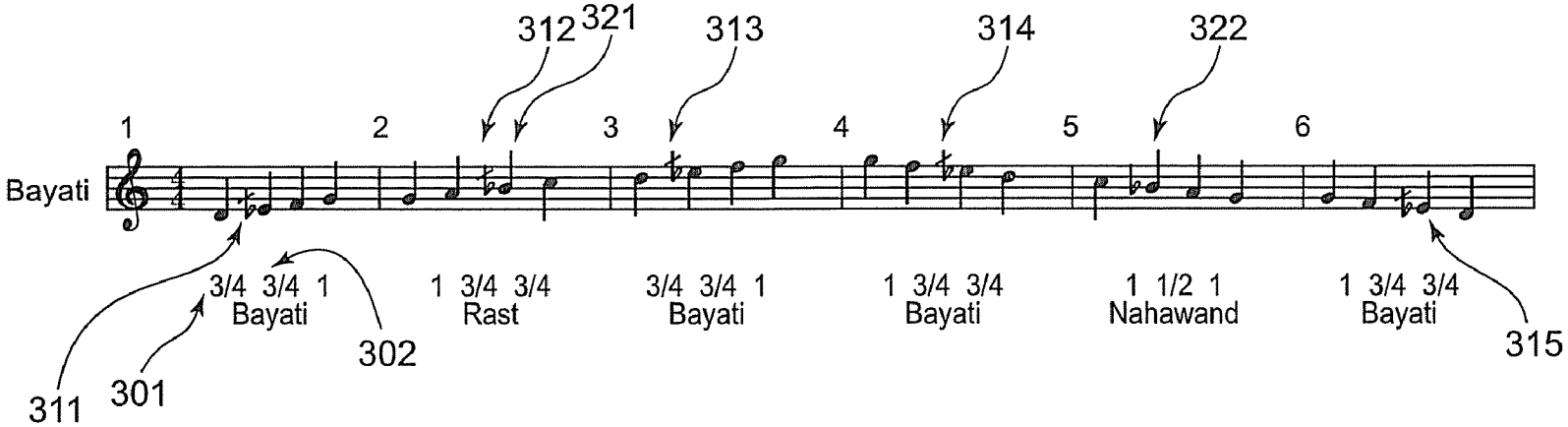
FIG. 3 is a view showing an example of a musical score, which expresses temperaments conforming with "Maqam Bayati" in "Maqam" or a melody type in Arabic music.

FIG. 3 is a view showing an example of a musical score, which expresses temperaments conforming with "Maqam Bayati" in "Maqam" or a melody type in Arabic music. "Maqam Bayati" can be divided into six four-note temperaments (for tetra-chords) "Maqam" is composed of a combination of "ajnas" (pl. of "jins") such as tri-chords and tetra-chords, that is, a combination of certain temperament patterns. The temperament pattern or temperament type is called a "jins" in Arabic music and also called a "gushe" in other areas, for example, in Persia.

"Maqam Bayati" shown in FIG. 3 is made up 6 ajnas. A "jins" of the first measure ("first jins") shown in FIG. 3 is "Bayati", a "jins" of the second measure ("second jins") is "Rast", a "jins" of the third measure ("third jins") is "Bayati", a "jins" of the fourth measure ("fourth jins") is "Bayati", a "jins" of the fifth measure ("fifth jins") is "Nahawand", and a "jins" of the sixth measure ("sixth jins") is "Bayati". The first jins to third jins are upward motion figures, and the fifth jins and sixth jins are downward figures. These ajnas are four-note temperaments or tetra-chords.

In FIG. 3, a symbol, "♭(flat) with a slash" (refer to Reference numbers 311 to 315) means that a tone with the symbol attached has a pitch higher by about ¼ tone than the tone with simple "♭(flat)" attached. For instance, the second tone in the first jins has a pitch higher than "E♭" by about ¼ tone. Therefore, assuming that the whole pitch range of all the tones is "1", a difference between the first tone and the second tone and a difference between the second tone and the third tone will be "¾", respectively. In FIG. 3, a numeral (for example, refer to Reference numbers: 301, 302) written beneath and between two musical notes indicates the difference between the adjacent musical notes with assumption that the whole pitch range of all the tones is "1". In the actual "Maqam Bayati", change is not ¼ tone strictly, but since the change is about ¼ tone, it will be described in the present description that the change is ¼ tone.

When the player plays the electronic musical instrument in conformity with the maqam in Arabic music, the instrument is required to produce a musical tone in conformity with the jins if needed, which is higher by ¼ tone than a tone of a depressed key. But as shown in FIG. 3, in "Maqam Bayati", even though the same key is depressed, sometimes a musical tone of a different pitch can be produced depending on the used jins.

In "Maqam Bayati" shown in FIG. 3, when the third tone (Reference number: 321) in the second jins is played, it is necessary for the player to depress the key of "B♭" and the electronic musical instrument produces a musical tone of a pitch higher than "B♭" by ¼ tone. Meanwhile, when the second tone (Reference number: 322) in the fifth jins is played, it is necessary that the player depresses a key of "B♭" and the electronic musical instrument produces a musical tone of a pitch of "B♭", as depressed by the player.

Figure 4:
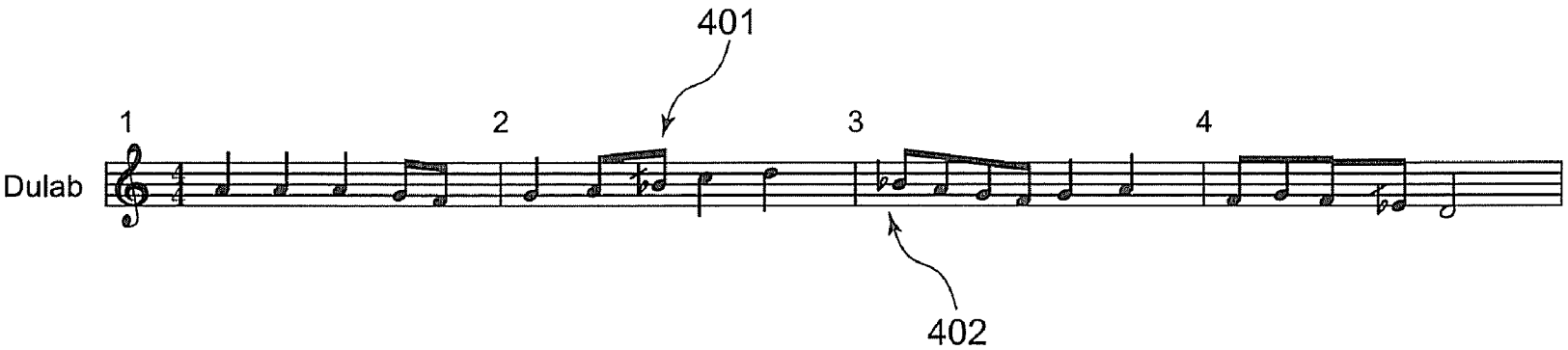
FIG. 4 is a view showing an example of music played in conformity with "Maqam Bayati".

FIG. 4 is a view showing an example of music played in conformity with "Maqam Bayati". In the music, the second measure conforms to "Rast", and meanwhile, the third measure conforms to "Nahawand". Therefore, the third tone in the second measure has a pitch higher than "B♭" by ¼ tone (refer to Reference number: 401), and the first tone in the second measure has a pitch of "B♭" (refer to Reference number: 402). Therefore, it is preferable that the electronic musical instrument can decide whether it should produce a musical tone having the same pitch as the depressed tone or having a microtone (in this case, a musical tone having a pitch higher by ¼ tone).

Figure 5A:
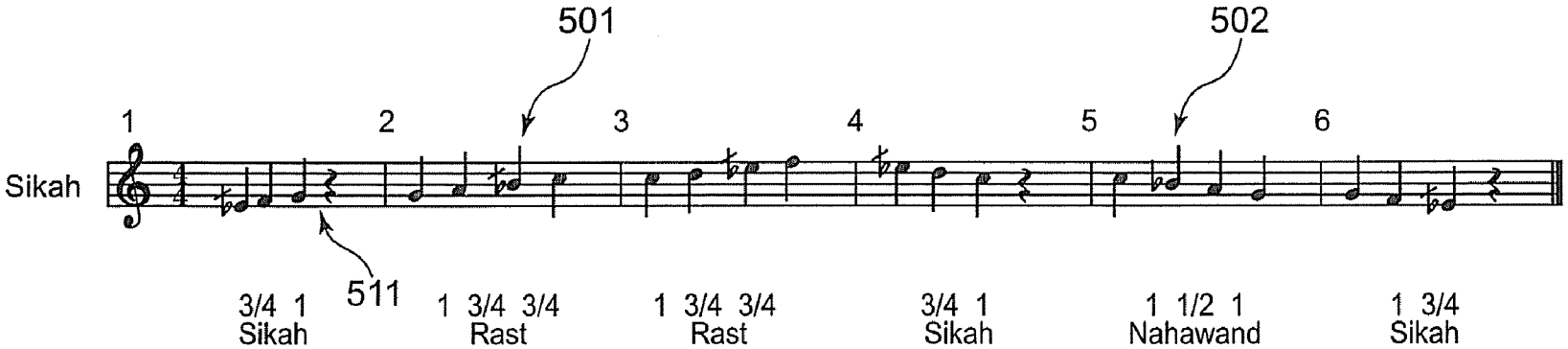
FIGS. 5*a* and 5*b* are views showing examples of temperaments conforming with "Maqams" other than "Maqam Bayati".
Figure 5B:
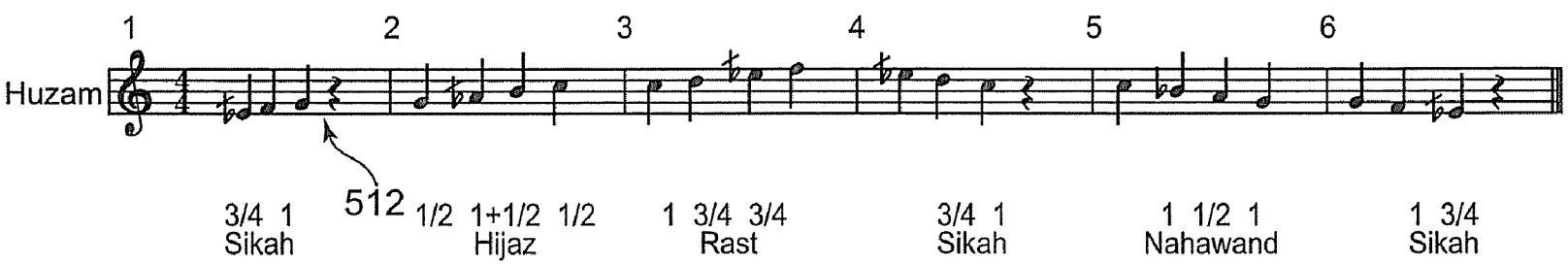

FIGS. 5*a* and 5*b* are views showing examples of temperaments conforming to maqams other than "Maqam Bayati". FIG. 5*a* is a view showing an example of temperaments of "Maqam Sikah". FIG. 5*b* is a view showing an example of temperaments of "Maqam Huzam". In "Maqam Sikah" shown in FIG. 5*a*, the jins (first jins) of the first measure is "Sikah", the jins (second jins) of the second measure is "Rast", the jins (third jins) of the third measure is "Rast", the jins (fourth jins) of the fourth measure is "Sikah", the jins (fifth jins) of the fifth measure is "Nahawand", and the jins (sixth jins) of the sixth measure is "Sikah". The first jins to third jins are the upward motion figures and the fifth jins and sixth jins are the downward motion figures. A problem can be caused, between the third note (Reference number: 501) in the second jins and the second note (Reference number: 502) in fifth jins, when the same key is depressed.

In "Maqam Huzam" shown in FIG. 5*b*, the jins (first jins) of the first measure is "Sikah", the jins (second jins) of the second measure is "Hijaz", the jins (third jins) of the third measure is "Rast", the jins (fourth jins) of the fourth measure is "Sikah", the jins (fifth jins) of the fifth measure is "Nahawand", and the jins (sixth jins) of the sixth measure is "Sikah". The first jins to third jins are the upward motion figures and the fifth jins and sixth jins are the downward motion figures.

The jins of "Sikah" used in "Maqam Sikah" and "Maqam Huzam" is a three-note temperament, that is, tri-chord. In FIGS. 5*a* and 5*b*, rests (for instance, Reference numbers: 511, 512) are described for convenience sake, which appear at the end of the measures, in which "Sikah" is used, and these rests do not mean to take a rest at the end of the measures when the music is played.

In the electronic musical instrument 10 according to the present embodiment, data of jins and data of maqam are stored in ROM 22 to produce musical tones of pitches conforming to maqam. FIG. 6 is a view showing an example of a data structure of jins used in the electronic musical instrument 10 according to the present embodiment. FIG. 7 is a view showing an example of a data structure of maqam used in the electronic musical instrument 10 according to the present embodiment.

As shown in FIG. 6, a data record (Reference number: 600) of the jins contains items such as Jins No., Jins Name, Lowest Tone, Interval between the first tone and the second tone, Interval between the second tone and the third tone, Interval between the third tone and the fourth tone, Interval between the fourth tone and the fifth tone, Interval between the lowest tone and the highest tone in the jins, and Jins Sort. In the example shown in FIG. 6, since a five-note temperament, or penta-chord is not shown, no data is stored in the item (Reference number: 611) of the Interval between the fourth tone and the fifth tone. The interval of tone is expressed in the unit of cent (1200/octave).

For example, data of "Rast" is stored in the data record of Jins No. 1 (Reference number: 601). In the data record of the jins of "Rast" are stored data as follows: "Rast" as Jins Name; "C" as Lowest Tone; "200 cent" as Interval between the first tone and the second tone; "150 cent" as Interval between the second tone and the third tone; "150 cent" as Interval between the third tone and the fourth tone; "500 cent" as Total Interval between the lowest tone and the highest tone; and "tetra-chord" as Jins Sort.

Data of "Sikah" is stored in the data record of Jins NO. 5 (Reference number: 602). In the data record of the jins of "Sikah" are stored data as follows: "Sikah" as Jins Name; "C" as Lowest Tone; "150 cent" as Interval between the first tone and the second tone; "200 cent" as Interval between the second tone and the third tone; "350 cent" as Total Interval between the lowest tone and the highest tone; and "tri-chord" as Jins Sort. Further, concerning "Hijaz", two data records, "Hijaz 1" and "Hijaz 2" (Reference number: 603) are stored in the data record 600.

As shown in FIG. 7, the data record (Reference number: 700) of maqam contains items such as Maqam NO., Maqam Name, and jins items of each of the first jins to sixth jins, wherein the jins items include Jins Name, Lowest Tone, and Up/Down (Upward Motion/Downward Motion). For instance, in the data record of Maqam No. 1 are stored data as follows: "Rast" in Maqam Name; "Rast", "C" and "Up (U)" in Jins Name, Lowest Tone and Up/Down of the first jins, respectively; "Rast", "G" and "Up (U)" in Jins Name, Lowest Tone and Up/Down of the second jins, respectively; "Rast", "C" and "Up (U)" in Jins Name, Lowest Tone and Up/Down of the third jins, respectively; "Rast", "G" and "Down (D)" in Jins Name, Lowest Tone and Up/Down of the fourth jins, respectively; "Nahawand", "C" and "Down (D)" in Jins Name, Lowest Tone and Up/Down of the fifth jins, respectively; and "Rast", "G" and "Down (D)" in Jins Name, Lowest Tone and Up/Down of the sixth jins, respectively.

In the case of the upward motion figure (U), the temperament starts with the lowest tone and the pitches are decided in order of the first tone, the second tone and so on in the data record of the jins. Meanwhile, in the case of the downward motion figure (D), the highest tone will be the final tone. In other words, in case of the tetra-chord, the pitches will be decided in order of the fourth tone, the third tone, . . . , the first tone.

In the data record 700 shown in FIG. 7, Jins Name is used to designate a jins, but as a matter of course, Jins No. can be used instead of Jins No. to designate the jins. As described above, in the case that the jins is an upward motion figure, this means that the order is from the first tone to the forth tone (in the case of the tetra-chord) in the data record of the corresponding jins. In the case that the jins is a downward motion figure, this means that the order is from the fourth tone to the first tone (in the case of the tetra-chord) in the data record of the corresponding jins. In FIG. 7, the lowest tone "E♭" with a slash is a microtone of "E♭". In the present embodiment, the tone of "E♭" with a slash means a tone which is higher than "E♭" by about ¼ tone.

The data of maqam and data of jins described above are stored in ROM 22. When Arabic music is played, the data of maqam and data of jins are read from ROM 22 to RAM 23. Predetermined data records are read from RAM 23, whereby musical tones are produced in accordance with the maqam.

Figure 8:
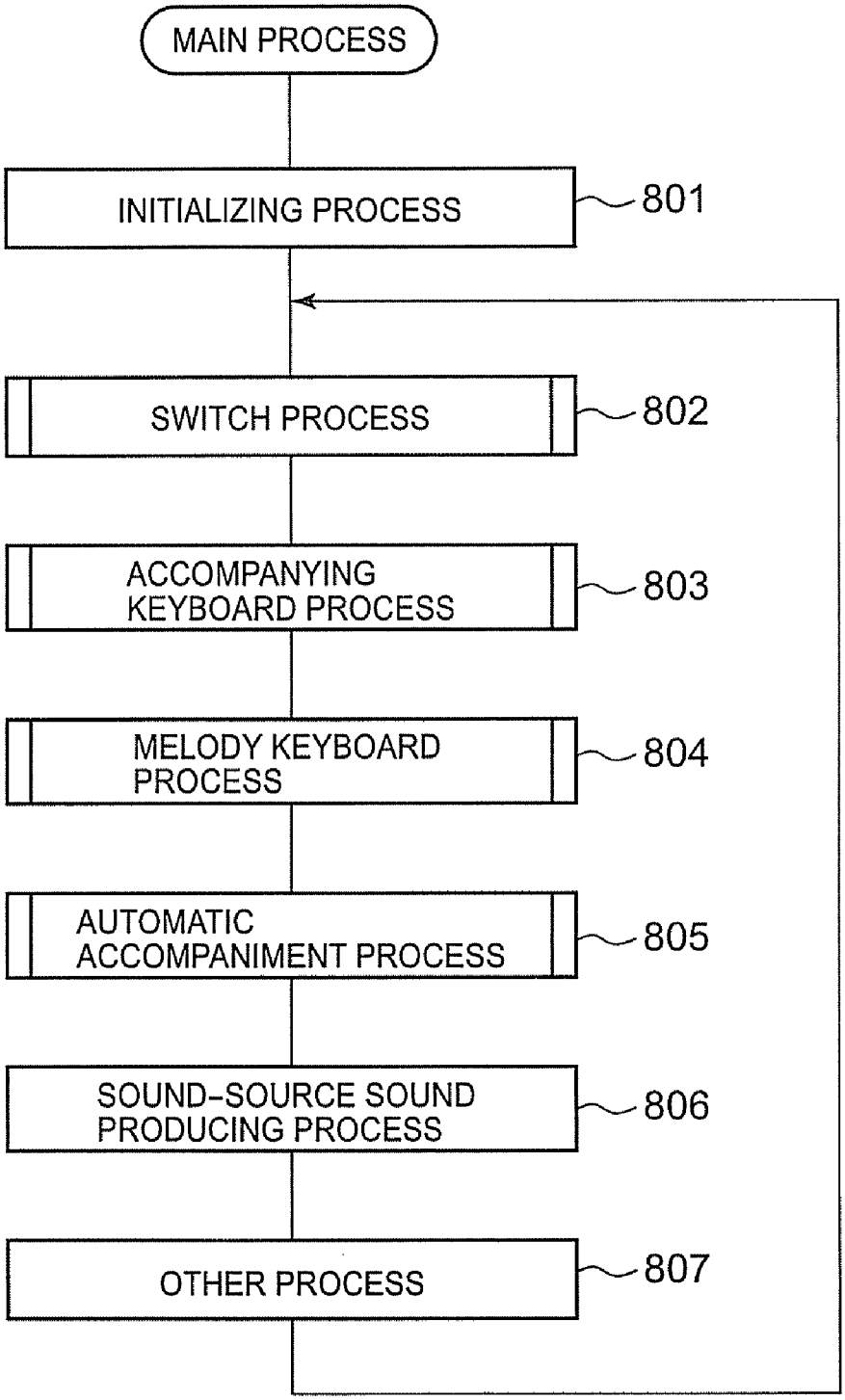
FIG. 8 is a flow chart of an example of a main process performed in the electronic musical instrument according to the embodiment of the invention.

Now, the main operation of the electronic musical instrument 10 according to the present embodiment will be described in detail. FIG. 8 is a flow chart of an example of a main process to be performed in the electronic musical instrument 10 according to the present embodiment. When the power of the electronic musical instrument 10 is turned on, CPU 21 performs an initializing process at step 801, clearing data in RAM 23 and an image displayed on the displaying unit 15. In the initializing process, CPU 21 reads the data of maqams and ajnas from ROM 22, and stores the read data in the predetermined area of RAM 23.

Figure 9:
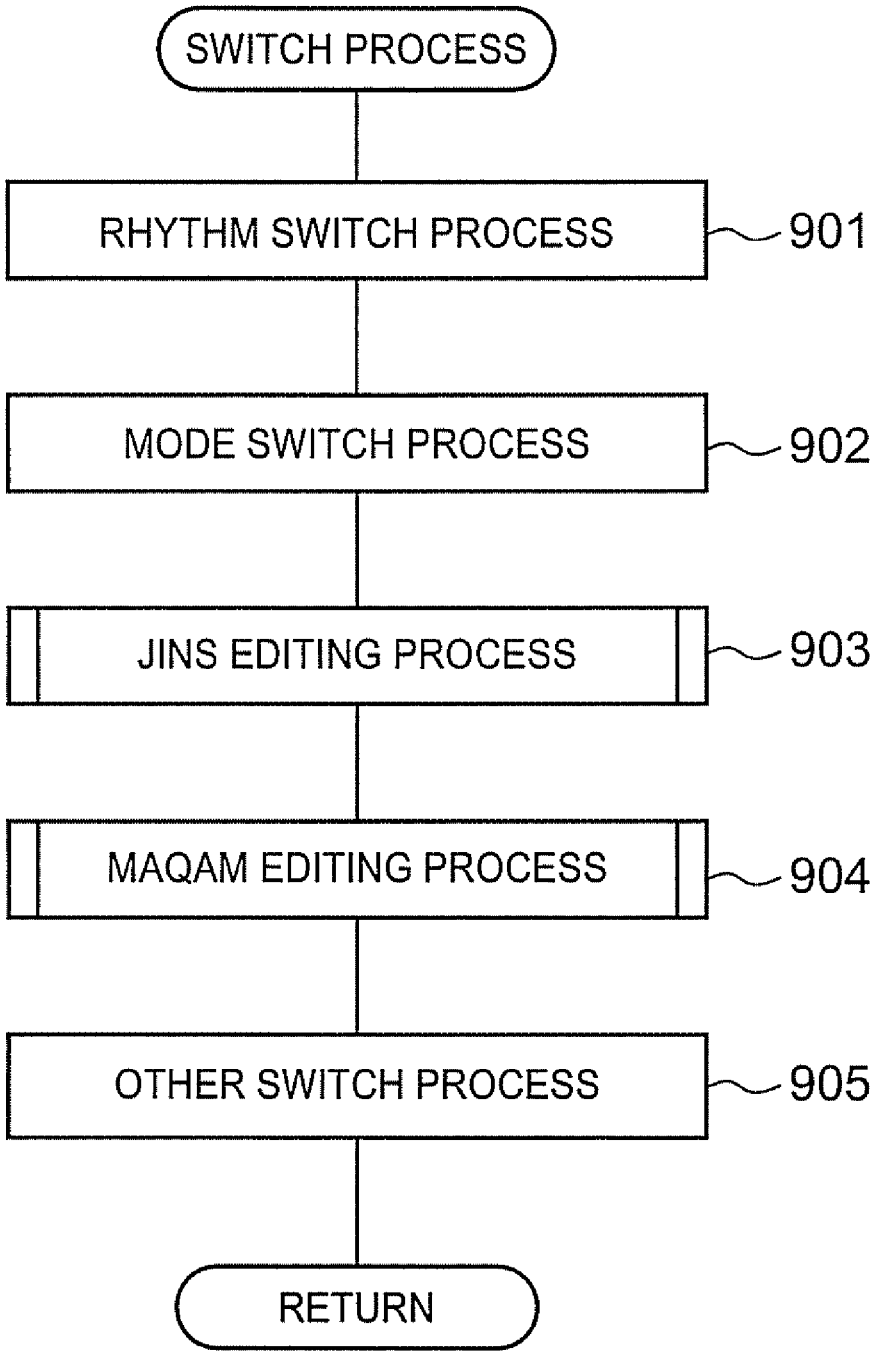
FIG. 9 is a flow chart of an example of a switch process performed in the embodiment.

After the initializing process at step 801, CPU 21 performs a switch process at step 802, detecting the manipulated state of switches included in the switch group 25 and performing processes in accordance with the detected manipulated state of the switches. FIG. 9 is a flow chart of an example of the switch process to be performed in the present embodiment. CPU 21 performs a rhythm switch process at step 901. In the rhythm switch process, CPU 21 specifies a rhythm number indicating an automatic accompanying pattern in accordance with a switching operation by the player, and stores the rhythm number in a predetermined area of RAM 23.

FIG. 10 is a view showing an example of a data structure of rhythm data. As shown in FIG. 10, the data records (Reference numbers: 1001, 1002) of the rhythm data 1000 have items as follows: Rhythm No.; Rhythm Name; Japanese Expression of Rhythm Name; Timbre No. of Melody Timbre; Timbre No. of Chord Timbre; Tempo; Maqam No.; and Accompaniment Pattern No. In the item of Maqam No, a maqam number is stored in the item of Maqam No. (Reference number: 1002), when a musical tone of a pitch conforming to the temperament defined by the maqam is to be produced.

When a rhythm number has been selected, an appropriate rhythm pattern, melody timbre in the automatic accompaniment, chord timbre in the automatic accompaniment, an initial tempo and accompaniment pattern are specified. In case a maqam number is included, pitches in automatic accompaniment and performance on the melody-key range to be described later are decided in accordance with the maqam corresponding to the maqam number.

Further, CPU 21 performs a mode switch process at step 902. CPU 21 judges depending on the player's operation of an accompaniment-mode selecting switch (Reference number: 1305 in FIG. 13 to be described later) whether or not the automatic accompaniment mode has been selected (step 902). When it is determined that the automatic accompaniment mode has been selected, then CPU 21 judges which mode has been selected out of the following modes: a finger mode, a simple playing mode, and a tetra-chord mode. In the finger mode, a chord name is decided based on pitches of keys actually depressed in the accompanying-key range. In the simple playing mode (accompaniment mode of so-called "Casio chords"), a chord name is decided based on the number of depressed keys and a pitch of the lowest tone. In the tetra-chord mode, music is played in accordance with maqams. Data of the selected automatic accompaniment mode is stored in a predetermined area of RAM 23.

Figure 11:
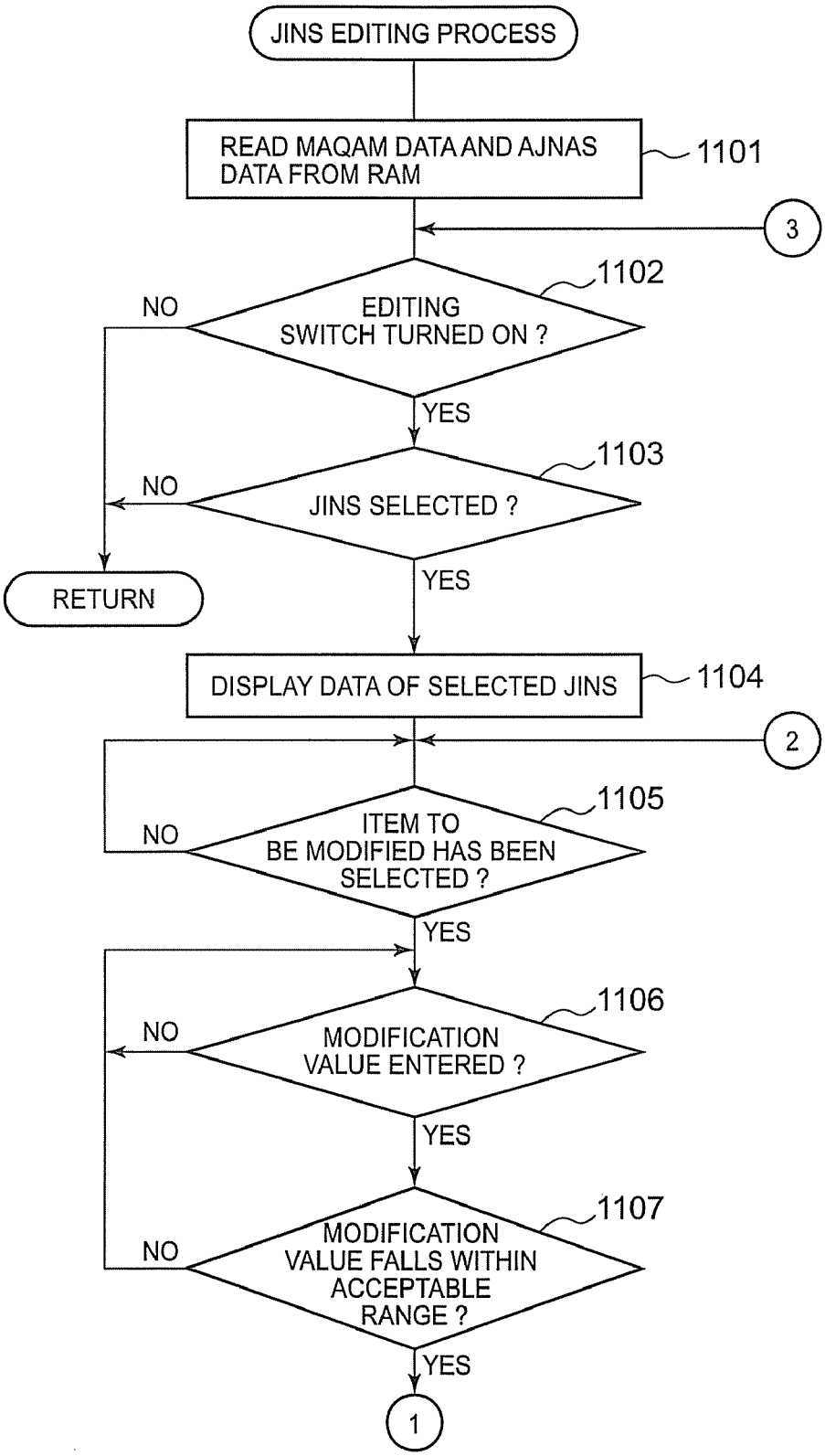
FIG. 11 is a flow chart of a jins editing process performed in the embodiment.
Figure 12:
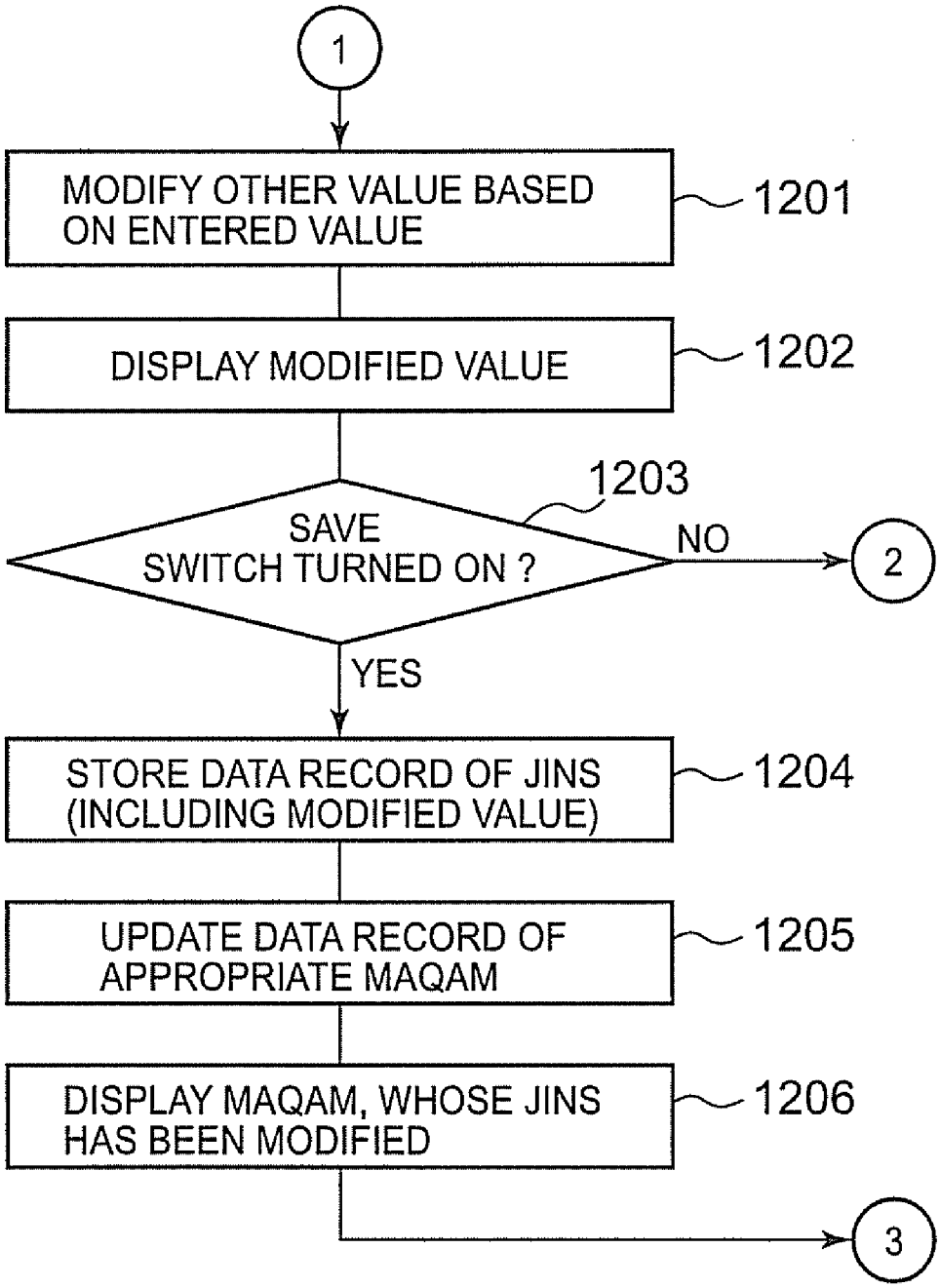
FIG. 12 are a flow charts of the jins editing process performed in the embodiment.

Then, CPU 21 performs a jins editing process at step 903 in FIG. 9. FIGS. 11 and 12 are flow charts of the jins editing process to be performed in the present embodiment. Based on the rhythm number selected in the rhythm switch process, CPU 21 refers to the record of rhythm data stored in ROM 22, obtaining a maqam number contained in said record.

CPU 21 reads from ROM 22 a data record of a maqam specified by the maqam number and data records of plural ajnas specified by the data record of the maqam (step 1101). In the case no maqam number is found in the record of the rhythm data, or in the case the maqam number is an ineffective value, the jins editing process and the following maqam editing process (step 904) are not performed.

Figure 13:
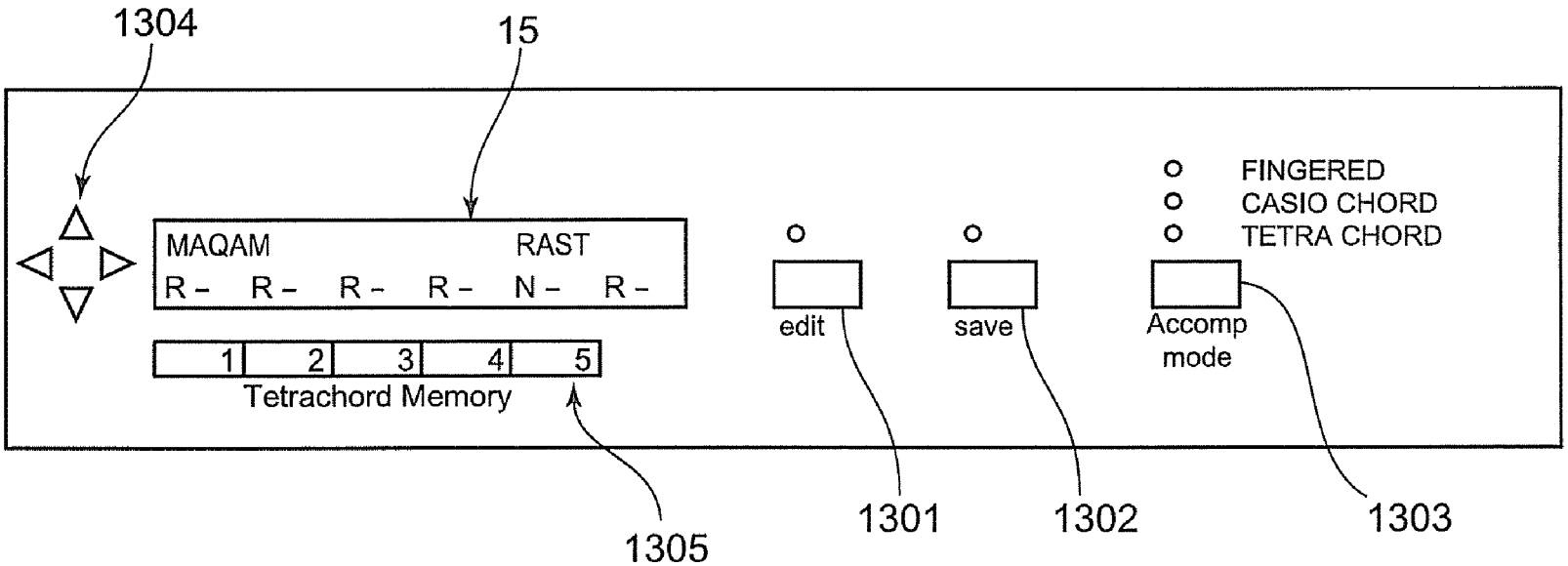
FIG. 13 is a view showing an example of switches used for an editing purpose and a displaying unit, provided on the electronic musical instrument according to the embodiment.

CPU 21 judges at step 1102 whether an editing switch has been turned on or not. When it is determined YES at step 1102, CPU 21 judges at step 1103 whether or not a jins to be edited has been selected. FIG. 13 is a view showing switches used for an editing purpose and the displaying unit 15, provided on the electronic musical instrument 10 according to the present embodiment. As shown in FIG. 13, on a front panel of the electronic musical instrument 10 are arranged an editing switch 1301, a save switch 1302, an accomp mode switch 1303, cursor keys 1304, and Tetra-chord Memory selecting switches 1305. An object to be edited can be selected on the displaying unit 15 by operating one of the cursor keys 1304.

Figure 14A:
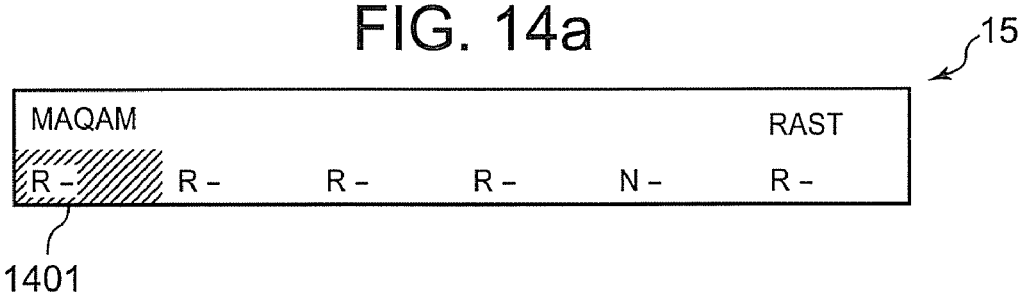
FIGS. 14*a* to 14*d* are views showing examples of editing screens of maqams and ajnas in the embodiment of the invention.

FIGS. 14*a* to 14*d* are views showing examples of editing screens of maqams and ajnas in the present embodiment. In FIG. 14*a*, on the upper right area of the displaying unit 15 is displayed MAQAM, which is selected at present. At the bottom of the displaying unit 15 are displayed the first jins to sixth jins, composing the selected maqam. In a hatched area 1401 of the displaying unit 15 is displayed the selected item. In this case, the first jins of "Maqam Rast" is selected to be edited by operation of the cursor keys and displayed in the hatched area of the displaying unit 15.

Figure 14B:
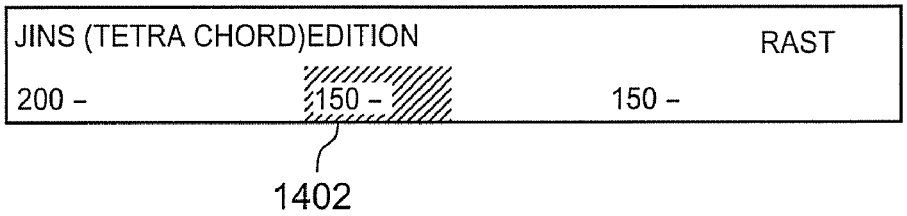

When it is determined YES at step 1103, that is, when one of the first jins to the sixth jins has been selected, CPU 21 refers to the selected maqam data and jins data, displaying the data of record of the selected jins (step 1104). In the case shown in FIG. 14*a*, since the first jins of "Maqam Rast" has been selected, the record of the jins data concerning "Rast" or the first jins of "Maqam Rast" is read and displayed (refer to FIG. 14*b*.) In FIG. 14*b*, numerals shown at the bottom of the displaying unit 15 indicate intervals between tones adjacent to each other, stored in the data record of "Rast" (Reference number: 601 in FIG. 6).

In the case that the selected jins is an upward motion figure, the intervals between tones adjacent to each other are indicated in an ascending order in pitch in the maqam data, such as the interval between the first tone (lowest tone) and the second tone, the interval between the second tone and the third tone, and so on. Meanwhile, in the case that the selected jins is a downward motion figure, the intervals between tones adjacent to each other are indicated in a descending order in pitch, such as the interval between the highest tone and the next highest tone (in the case of tetra-chord, the interval between the fourth tone and the third tone), the interval between the next highest tone and the third highest tone (in the case of tetra-chord, the interval between the third tone and the second tone), and so on.

Figure 14C:
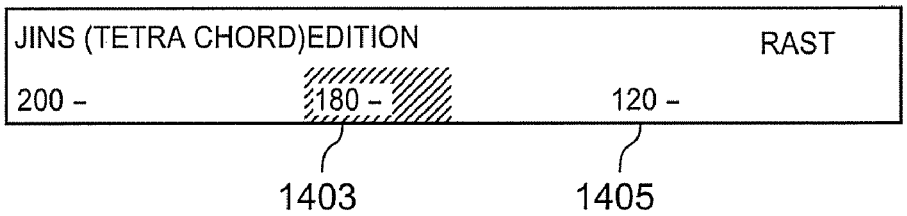
Figure 14D:
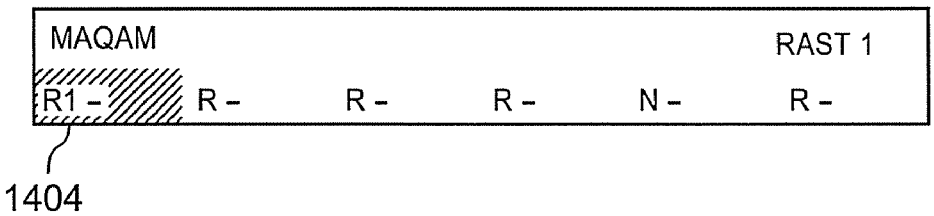

Then, CPU 21 judges whether or not an item to be modified has been selected by the player's manipulation of the cursor keys 1304 (step 1105 in FIG. 11). In FIG. 14*b*, the interval between the second tone and the third tone of the first jins is indicated (refer to Reference number: 1402). When it is determined YES at step 1105, CPU 21 judges at step 1106 whether or not a modification value has been entered to the selected item. FIG. 14*c* is a view showing the modification value (Reference number: 1403) which has been entered to the interval between the second tone and the third tone. CPU 21 judges at step 1107 whether or not the modification value falls within an acceptable range.

In the case that the jins is the tri-chord, the interval between first tone and the second tone, the interval between second tone and the third tone, and the interval between third tone and the fourth tone can be modified. In the present embodiment, when the interval between two tones has been modified, and if the higher tone (for instance, the second tone) among the two tones (for instance, the first tone and the second tone) has a pitch lower than the adjacent tone (for instance, the third tone) on the high pitch side, it is determined that such modification to the interval is acceptable. In other words, in the cases shown in FIGS. 14*b* and 14*c*, if the selected interval between the second tone and the third tone is less than "300", the modification value falls within the acceptable range.

When it is determined NO at step 1107, or when the modification value is not acceptable, then CPU 21 returns to step 1106. When it is determined YES at step 1107, or when the modification value is acceptable, then CPU 21 modifies other interval based on the entered modification value at step 1201 in FIG. 12. In the present embodiment, the interval (refer to Reference number: 1405 in FIG. 14*c*) on the upper side of the modified interval is modified.

Thereafter, CPU 21 displays on the displaying unit 15 the modified value and other value modified based on the modification value as shown in FIG. 14*c* (step 1202). Then, CPU 21 judges at step 1203 whether or not the save switch 1302 has been turned on. When it is determined YES at step 1302, CPU 21 stores at step 1204 data record of jins including the modification values in a predetermined area of RAM 23. FIG. 15 is a view showing the data structure of jins with a new record added in RAM. As shown in FIG. 15, the data record including the modified values shown in FIG. 14*c* is stored in the item of Jins NO. of "User 1" (Reference number: 1501).

CPU 21 updates data to a data record of the maqam having the jins modified in the jins editing process described above (step 1205). For instance, in the case shown in FIG. 14*a*, the value of the first jins of "Maqam Rast" has been modified. Therefore, in the data record of maqam shown in FIG. 7, a data item of the first jins (Name of the first jins) in the data record of "Maqam Rast" is modified. Then, CPU 21 displays on the displaying unit 15 contents of the modified maqam, whose jins has been modified (step 1206). In the case shown in FIG. 14*d*, since the first jins has been modified, CPU 21 displays the maqam, whose first jins (Reference numeral: 1401) has been modified, and then returns to step 1102 in FIG. 11.

Figure 16:
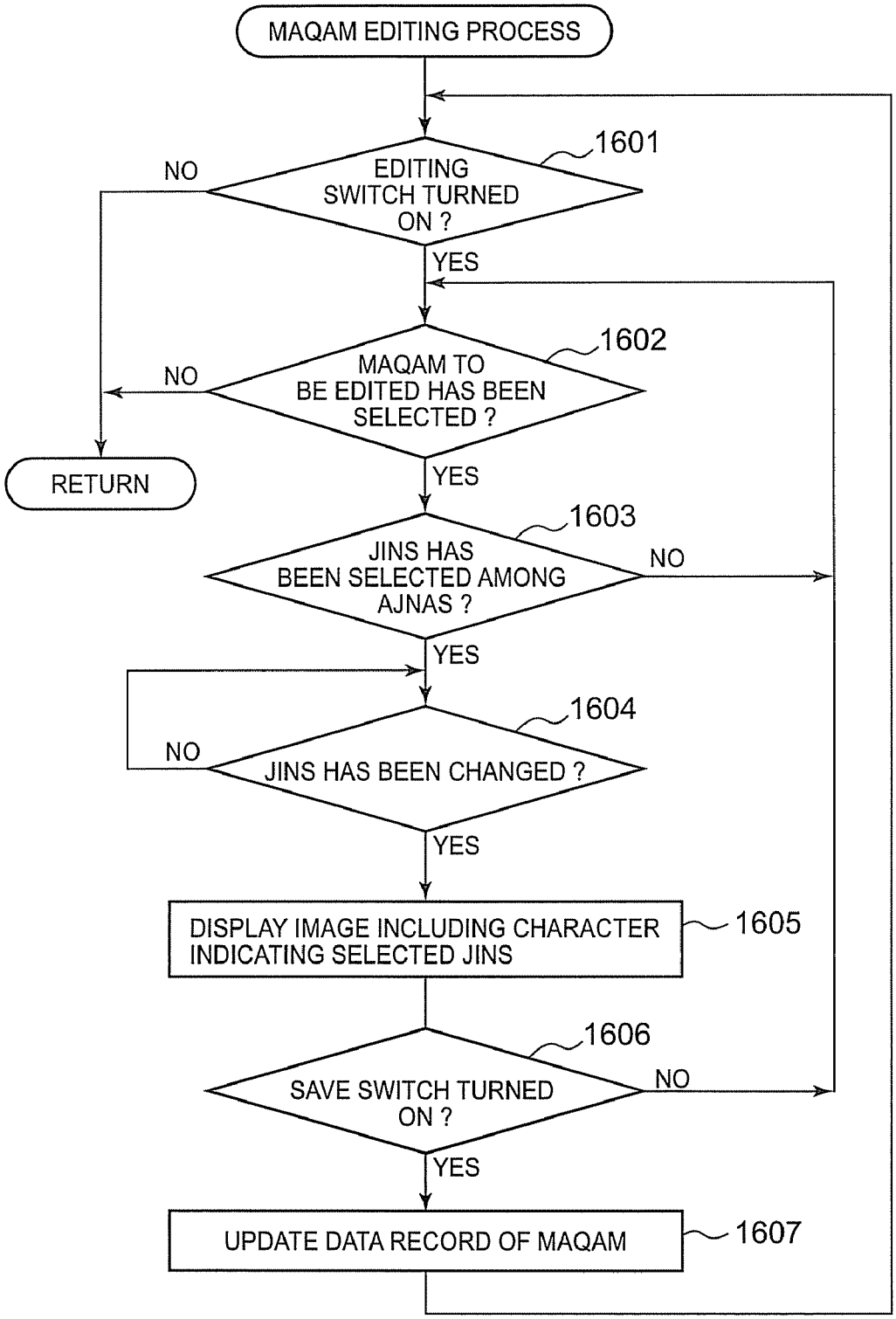
FIG. 16 is a flow chart showing an example of a maqam editing process performed in the embodiment of the invention.

When it is determined NO at step 1102, or when is determined NO at 1103 even when it is determined YES at step 1102, the jins editing process finishes. When the jins editing process finishes at step 903 in FIG. 4, CPU 21 performs a maqam editing process at step 904. FIG. 16 is a flow chart showing an example of the maqam editing process to be performed in the present embodiment.

Figure 17A:
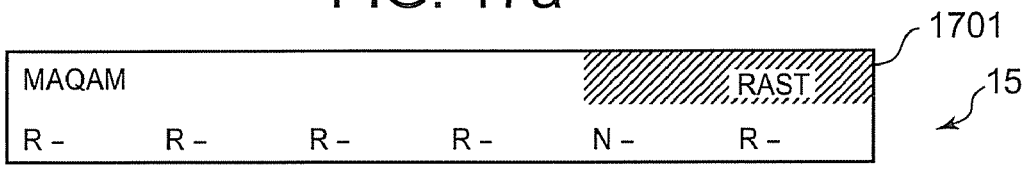
FIGS. 17*a* to 17*c* are views showing other examples of the maqam editing screens of the displaying unit 15 in the embodiment.
Figure 17B:
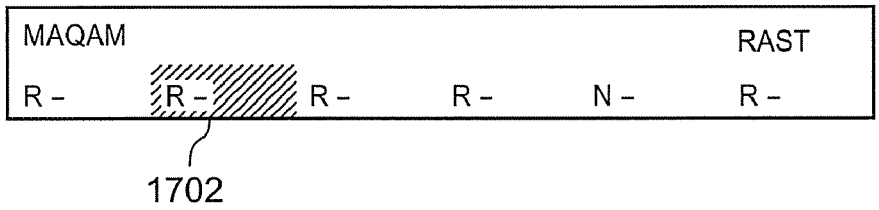
Figure 17C:
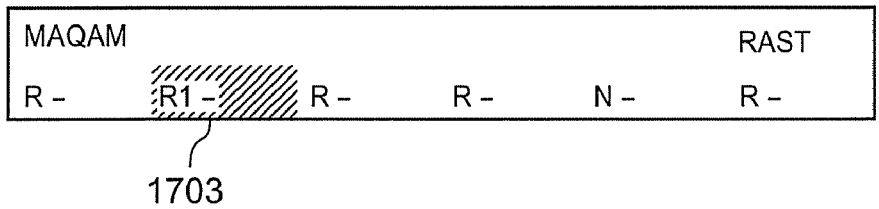

CPU 21 judges at step 1601 whether or not the editing switch has been turned on. When it is determined YES at step 1601, CPU 21 judges at step 1602 whether or not a maqam to be edited has been selected. FIGS. 17*a* to 17*c* are views showing other examples of the maqam editing screen of the displaying unit 15 in the present embodiment. As shown in FIG. 17*a*, "Maqam Rast" (Reference number: 1701) has been selected by the player's manipulation of the cursor keys 1304.

When it is determined YES at step 1602, CPU 21 judges at step 1603 whether or not any jins to be edited has been selected among the ajnas composing the maqam by the player's manipulation of the cursor keys 1304. As shown in FIG. 17*b*, the second jins of "Maqam Rast" (Reference number: 1702) has been selected.

CPU 21 judges at step 1604 whether or not the selected jins has been changed by the player's manipulation of the cursor keys 1304. In the case shown in FIG. 17*b*, the second jins is "R", that is, the second jins is "Rast", but the second jins can be changed to other jins, for example, to "Bayati" or to "Rast 1" produced in the jins edition by the player. When it is determined YES at step 1604, CPU 21 displays on the display unit 15 an image, in which a character indicating the selected jins is disposed at the position of the designated jins (step 1605). As shown in FIG. 17*c*, the second jins has been changed to "jins 1" (Jins No. User 1) produced in the jins edition.

Then, CPU 21 judges at step 1606 whether or not the save switch (Reference number: 1302 in FIG. 13) has been turned on. When it is determined YES at step 1606, CPU 21 updates at step 1607 data to a data record of the maqam including the modified value. For example, in the case shown in FIG. 17*c*, the second jins of "Maqam Rast" is modified. Therefore, in the data record of maqam shown in FIG. 7, a data item of the second jins (Name of the second jins) in the data record of "Maqam Rast" is modified.

When the maqam editing process finishes at step 904, CPU 21 performs other switch process at step 905. In the other switch process, updates of items such as timbre and tempo are displayed on the displaying unit 15 in addition to items concerning the maqams and ajnas.

Figure 18:
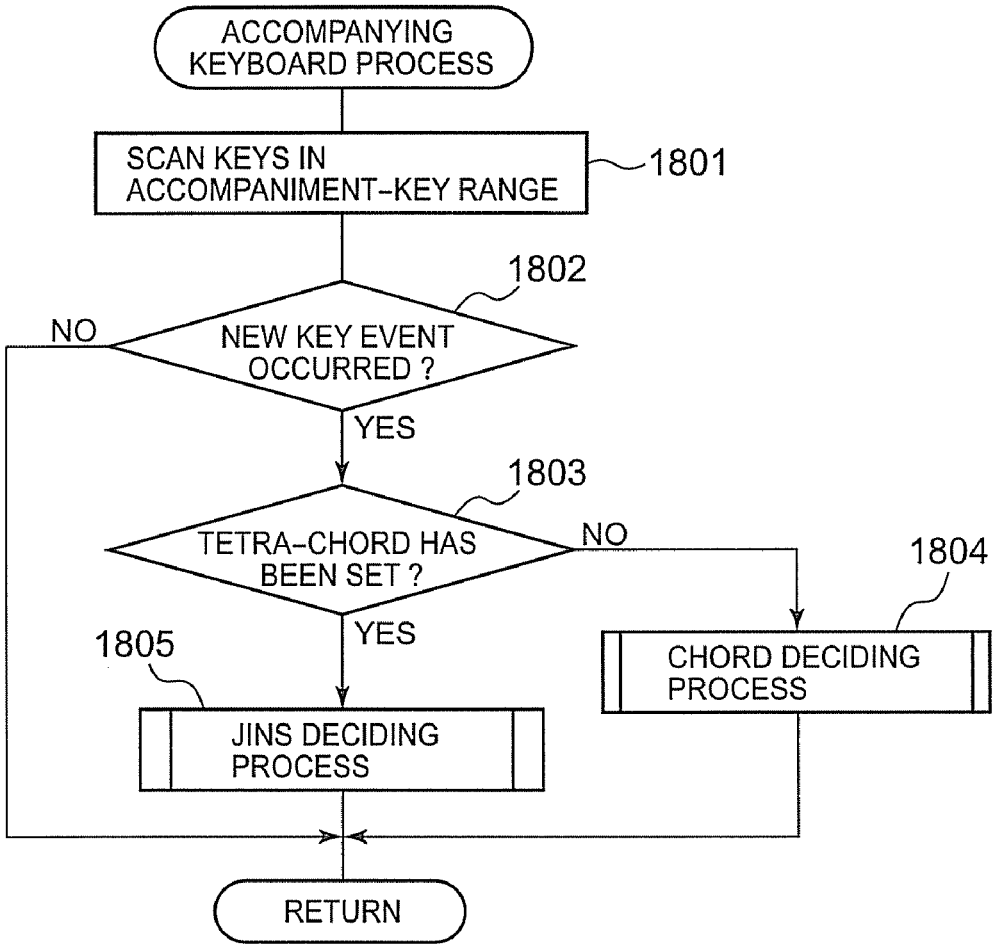
FIG. 18 is a flow chart of an example of an accompanying keyboard process performed in electronic musical instrument according to the embodiment.

When the switch process finished at step 802 in FIG. 8, CPU 21 performs an accompanying keyboard process at step 803. FIG. 18 is a flow chart of an example of the accompanying keyboard process to be performed in the present embodiment.

CPU 21 scans the keys in the accompaniment-key range 101 (step 1801), judging whether or not a new key-event (key-on or key-off) has occurred (step 1802). When it is determined YES at step 1802, CPU 21 judges at step 1803 whether or not the automatic accompaniment mode has been set to the tetra-chord mode. When it is determined NO at step 1803, CPU 21 performs a chord deciding process at step 1804. At step 1804, a chord name is decided based on the depressed keys in a similar manner to in conventional electronic instruments.

When the automatic accompaniment mode has been set to the finger mode, a chord name is decided based on pitches of keys actually depressed in the accompaniment-key range 101. When the automatic accompaniment mode has been set to the normal mode, a chord name is decided based on the number of depressed keys and the pitch of the lowest tone.

Figure 19:
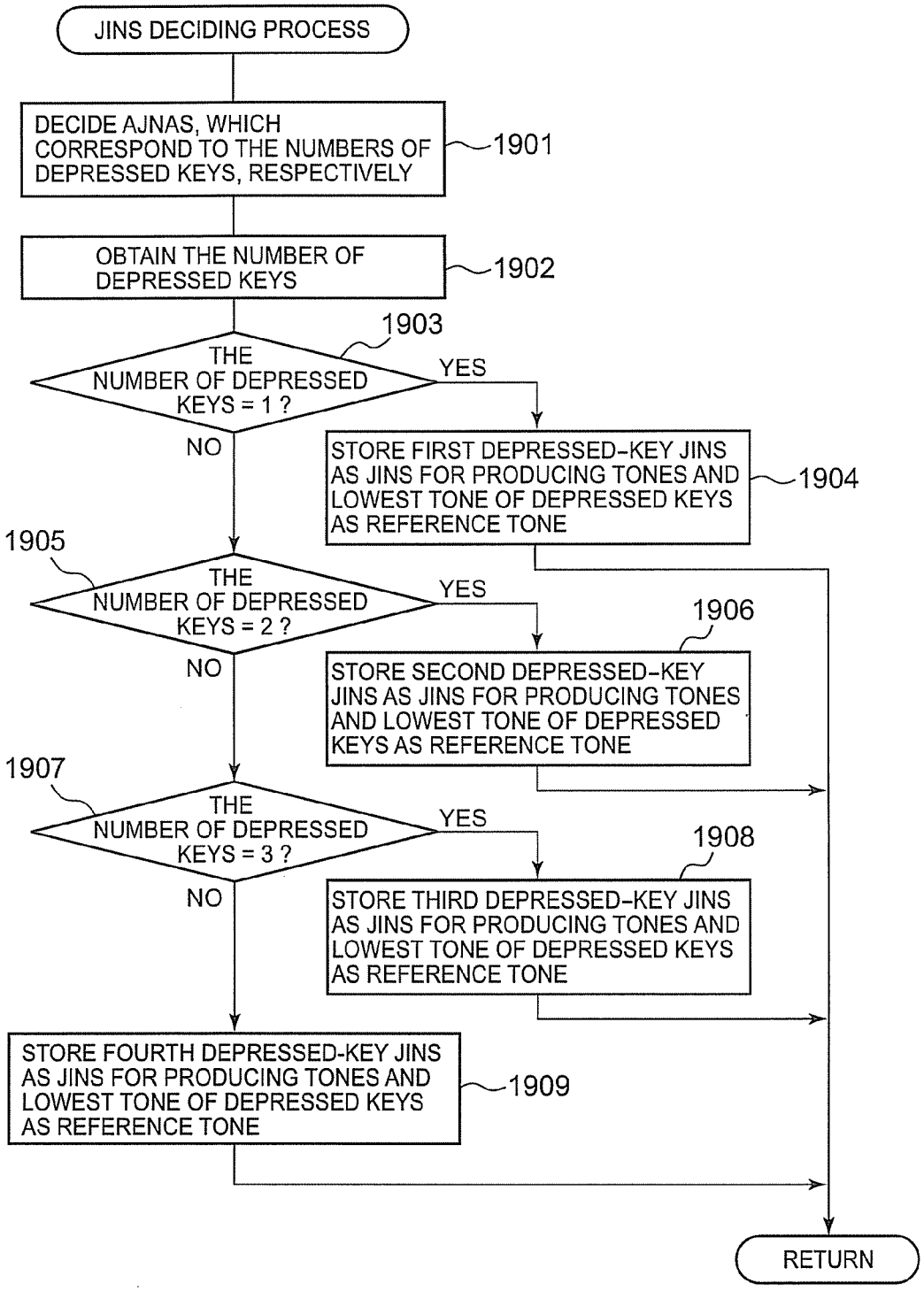
FIG. 19 is a flow chart of an example of a jins deciding process performed in the embodiment of the invention.

When it is determined YES at step 1803, CPU 21 performs a jins deciding process at step 1805. FIG. 19 is a flow chart of an example of the jins deciding process to be performed in the present embodiment. CPU 21 refers to the data record of the selected maqam to decide ajnas corresponding respectively to the numbers of depressed keys (step 1901). In the present embodiment, the numbers of depressed keys "1" to "4" correspond to ajnas, respectively. The jins corresponding to the number "1" of depressed key is called the "first depressed-key jins". The jins corresponding to the number "2" of depressed keys is called the "second depressed-key jins". The jins corresponding to the number "3" of depressed keys is called the "third depressed-key jins". The jins corresponding to the number "4" of depressed keys is called the "fourth depressed-key jins".

In the present embodiment, CPU 21 refers to the data record (from the first jins to the sixth jins) of the maqam. When a new jins appears, CPU 21 associates the new jins with the number of depressed keys. In other words, CPU 21 associates the jins with the number of depressed keys in the order conforming to the temperament type of the maqam and with duplication eliminated.

For example, in "Maqam Rast" shown in FIG. 7, the number of depressed keys=1 (first depressed-key jins): Rast (appears as the first jins), and the number of depressed keys=2 (second depressed-key jins): Nahawand (appears as the fourth jins). For example, in the third depressed-key jins and the fourth depressed-key jins are associated with the Nahawands which appear last.

In "Maqam Huzam" shown in FIG. 7, the number of depressed keys=1 (first depressed-key jins): Sikah 1 (appears as the first jins), the number of depressed keys=2 (second depressed-key jins): Hijaz 1 (appears as the second jins), the number of depressed keys=3 (third depressed-key jins): Rast (appears as the fourth jins), and the number of depressed keys=4 (fourth depressed-key jins): Nahawand (appears as the fourth jins).

Then, CPU 21 obtains at step 1902 the number of depressed keys in the accompaniment-key range 101, which are kept depressed now. When it is determined at step 1903 that the number of depressed keys is "1" (YES at step 1903), CPU 21 determines that the first depressed-key jins is used as a jins for producing tones and the lowest tone of the depressed keys is used as the reference tone of the jins, and stores information of the first depressed-key jins and information of the lowest tone in a predetermined area of RAM 23 (step 1904). The information of specifying the jins for producing musical tones and the reference tone are called tone-producing jins data.

When it is determined at step 1905 that the number of depressed keys is "2" (YES at step 1905), CPU 21 determines that the second depressed-key jins is used as a jins for producing tones and the lowest tone of the depressed keys is used as the reference tone of the jins, and stores information of the second depressed-key jins and information of the lowest tone in a predetermined area of RAM 23 (step 1906). When it is determined at step 1907 the number of depressed keys is "3" (YES at step 1907), CPU 21 determines that the third depressed-key jins is used as a jins for producing tones and the lowest tone of the depressed keys is used as the reference tone of the jins, and stores information of the third depressed-key jins and information of the lowest tone in a predetermined area of RAM 23 (step 1908).

When it is determined NO at step 1907, that is, when it is determined that the number of depressed keys is "4" or more, CPU 21 determines that the fourth depressed-key jins is used as a jins for producing tones and the lowest tone of the depressed keys is used as the reference tone of the jins, and stores information of the forth depressed-key jins and information of the lowest tone in a predetermined area of RAM 23 (step 1909).

Figure 20:
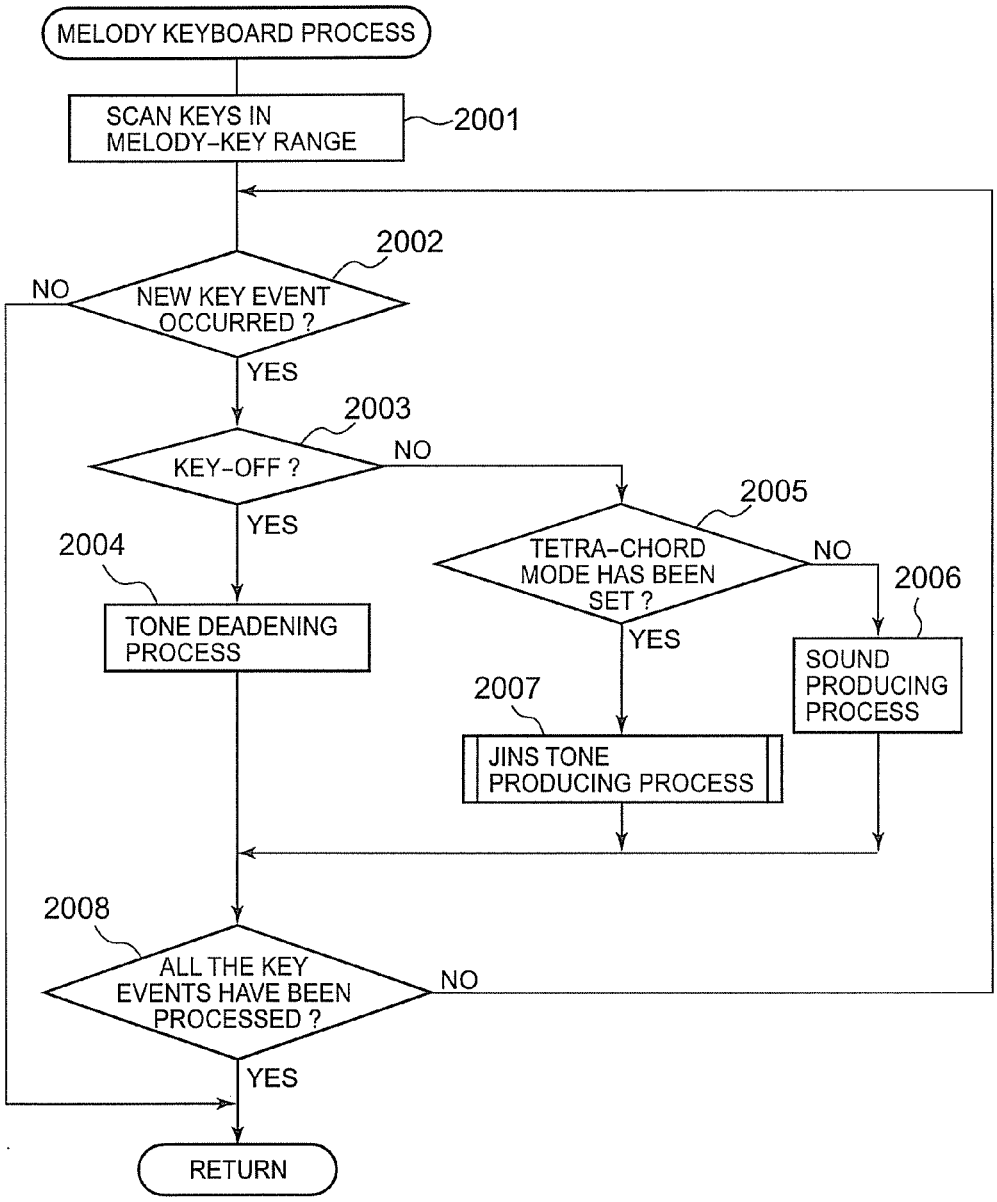
FIG. 20 is a flow chart of an example of a melody keyboard process performed in the embodiment.

When the accompanying keyboard process finishes at step 803 in FIG. 8, CPU 21 performs a melody keyboard process at step 804. FIG. 20 is a flow chart of an example of the melody keyboard process to be performed in the present embodiment. CPU 21 scans keys in the melody-key range 102 at step 2001 to judge at step 2002 whether or not any new key event (key-on or key-off) has occurred. When it is determined YES at step 2002, CPU 21 judges at step 2003 whether the new key event is key-off or not. When it is determined the key event is a key-off (YES at step 2003), CPU 21 performs at step 2004 the tone deadening process, deadening a musical tone of a key of the key-off. Actually, since the musical tone is deadened in a sound-source sound producing process at step 806 in FIG. 8, a key-off event is generated at step 2004.

When it is determined at step 2003 that the key event is a key-on (NO at step 2003), CPU 21 judges at step 2005 whether or not the automatic accompaniment mode has been set to the tetra chord mode. When it is determined NO at step 2005, CPU 21 produces a musical tone of a key of the key-on (step 2006). Actually, since the musical tone is produced in the sound-source sound producing process at step 806 in FIG. 8, a key-on event is created at step 2006. Meanwhile, when it is determined at step 2005 that the automatic accompaniment mode has been set to the tetra chord mode (YES at step 2005), CPU 21 performs a jins tone producing process at step 2007.

Figure 21:
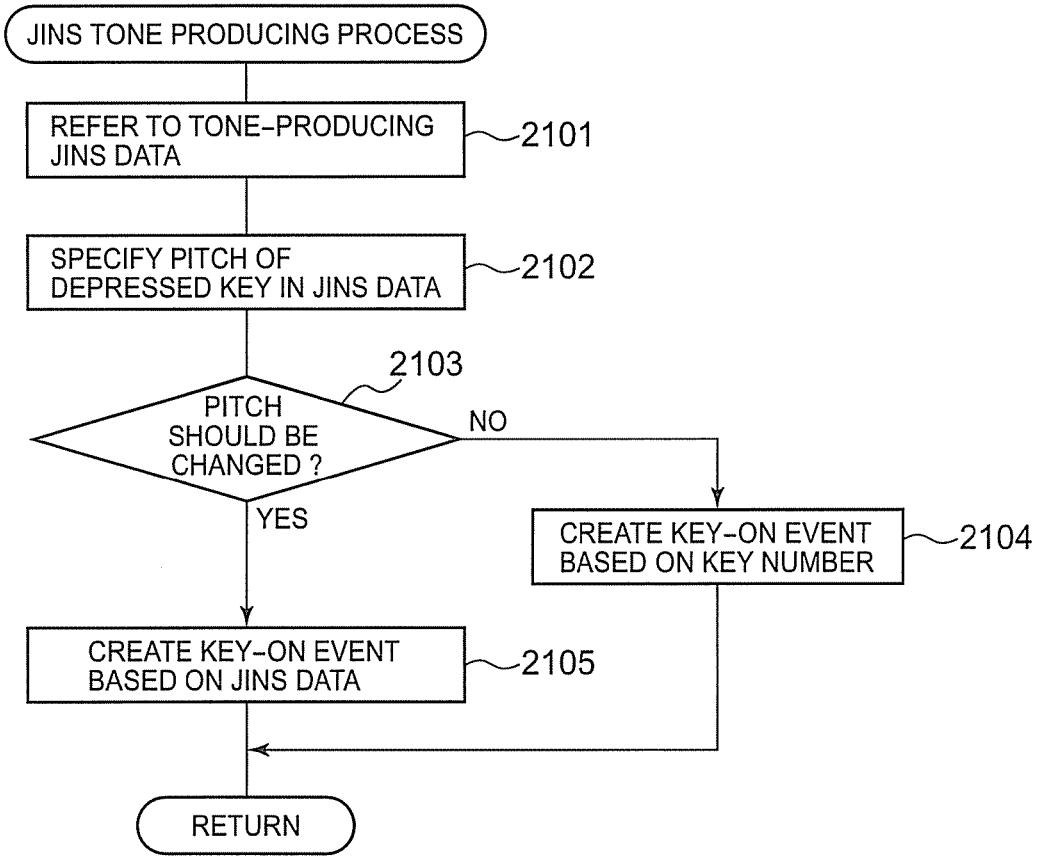
FIG. 21 is a flow chart of an example of a jins tone producing process performed in the embodiment.

FIG. 21 is a flow chart of an example of the jins tone producing process to be performed in the present embodiment. CPU 21 refers to the tone-producing jins data stored in RAM 23 (step 2101 in FIG. 21). The tone-producing jins data has been created based on the depressed keys in the accompaniment-key range 101 and stored in the predetermined area of RAM 23 at step 1904 in FIG. 19. The tone-producing jins data contains the information of the jins used for producing musical tones (data record of jins data) and the reference tone. Then, CPU 21 refers to the tone-producing jins data of depressed keys, and specifies pitches in accordance with data record of jins data corresponding to the depressed keys (step 2102). Then, CPU 21 judges at step 2103 whether a pitch of the depressed key should be changed or not.

At step 2103, CPU 21 modifies pitches of musical tones composing the jins based on a difference between the lowest tone in the jins data record and the reference tone. For example, in the case that the lowest tone in the data record is "C" and the reference tone is "D", the pitches of the musical tones composing the jins is increased by one tone (major second). Then, CPU 21 judges whether or not the pitch corresponding to the depressed key in the pitches modified in the jins is different from a pitch of white or black key in the normal keyboard. When the pitch corresponding to the depressed key is different from a pitch of white or black key in the normal keyboard (YES at step 2103), CPU 21 advances to step 2105).

When it is determined NO at step 2103, CPU 21 creates a key-on event in accordance with the key number of the depressed key (step 2104). Meanwhile, when it is determined YES at, step 2103, CPU 21 creates a key-on event in accordance with pitches modified based on the jins data and the reference tone (step 2105).

When the tone deadening process, the tone producing process and the jins tone producing process finish at steps 2004, 2006, and 2007, respectively, CPU 21 judges at step 2008 whether or not all the key events have been processed. When it is determined NO at step 2008, CPU 21 returns to step 2002. When it is determined YES at step 2008, the melody keyboard process finishes.

Figure 22:
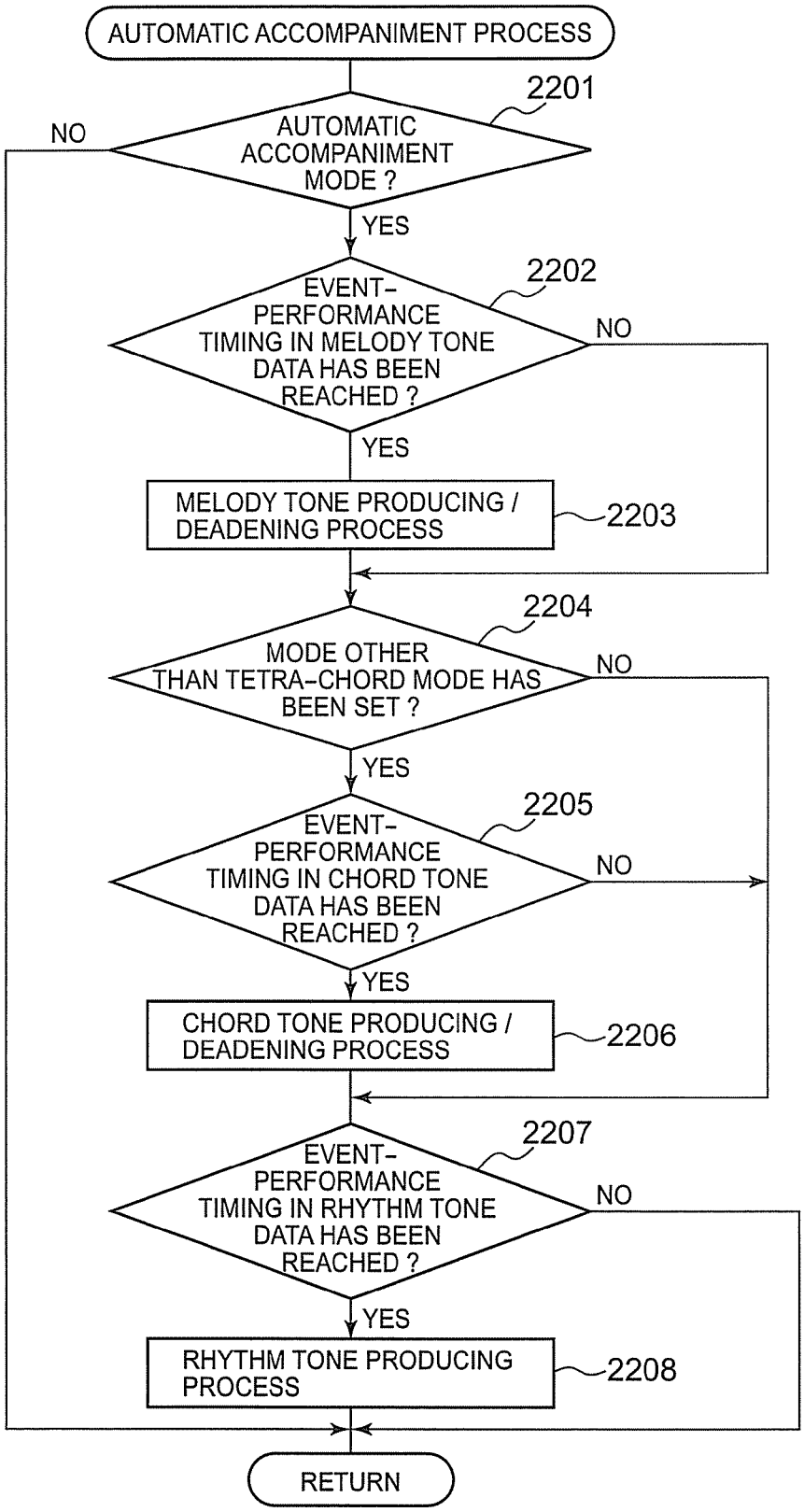
FIG. 22 is a flow chart of an example of an automatic accompaniment process performed in the embodiment.

When the melody keyboard process finishes at step 804 in FIG. 8, CPU 21 performs an automatic accompaniment process at step 805. FIG. 22 is a flow chart of an example of the automatic accompaniment process to be performed in the present embodiment. CPU 21 judges at step 2201 whether or not the electronic musical instrument 10 is operating in the automatic accompaniment mode. When it is determined YES at step 2201, CPU 21 refers to the timer (not shown) to judge whether or not an event-performance timing has been reached with respect to data of a melody tone in the automatic accompaniment data (step 2202).

As described above, the automatic accompaniment data contains data of three sorts of musical tones: melody tones (including obbligato tones), chord tones, and rhythm tones. Data of melody tones and data of chord tones contain timbre, a pitch, a tone producing timing, and a tone duration of each musical tone to be produced. Data of rhythm tones contains a tone producing timing of each rhythm tone.

Figure 23:
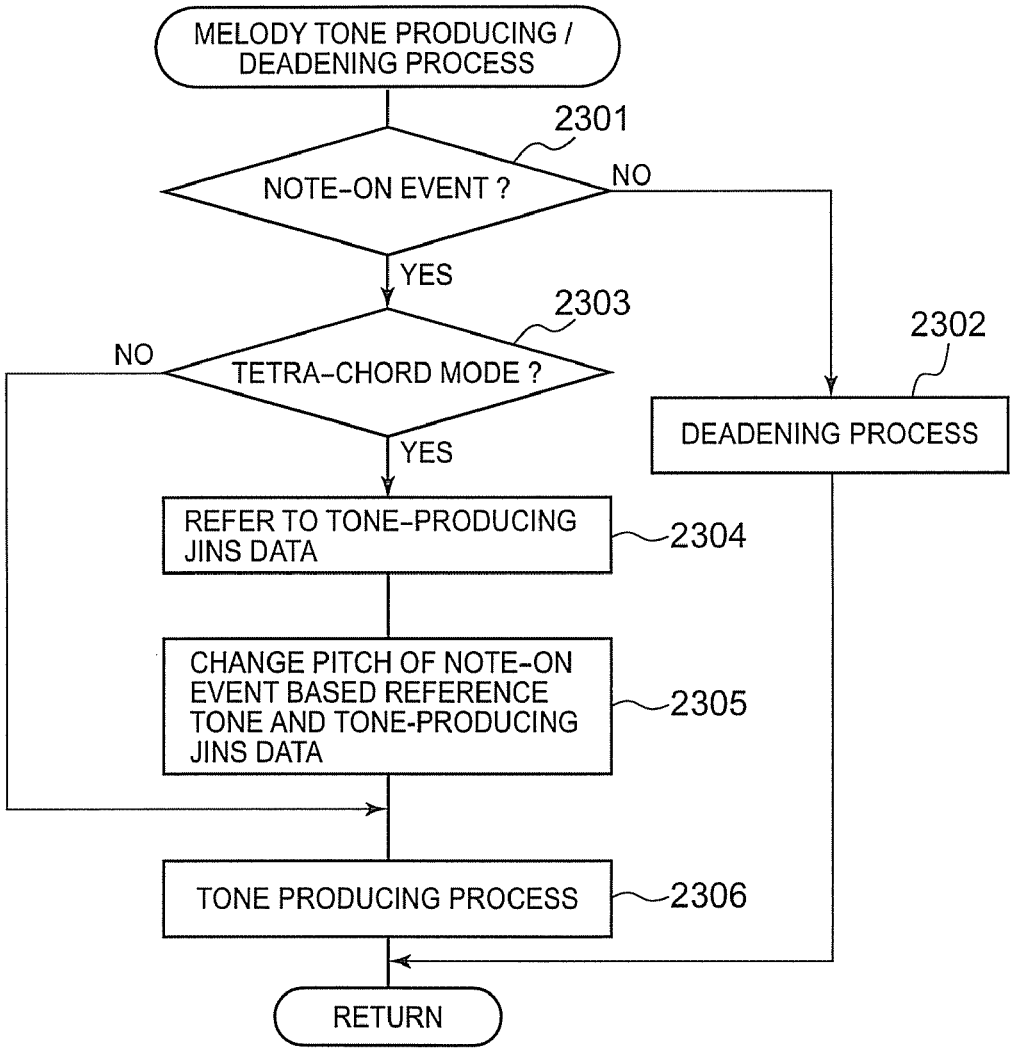
FIG. 23 is a flow chart of an example of a melody tone producing/deadening process performed in the embodiment.

When it is determined YES at step 2202, that is, when the event-performance timing has been reached (YES at step 2202), CPU 21 performs a melody tone producing/deadening process at step 2203. FIG. 23 is a flow chart of an example of the melody tone producing/deadening process to be performed in the present embodiment. In the melody tone producing/deadening process, CPU 21 judges at step 2301 whether or not an event to be processed is a note-on event. It is determined that the event to be processed is a note-on event, when the current time substantially coincides with a tone producing timing of a musical tone in the data of a melody tone. Meanwhile, it is determined that the event to be processed is a note-off event, when the current time substantially coincides with a time when a tone duration will lapse after the tone producing timing of a musical tone in the data of a melody tone.

When it is determined NO at step 2301, that is, when it is determined that the event to be processed is not a note-on event (NO at step 2301), CPU 21 performs the tone deadening process at step 2302. Meanwhile, it is determined YES at step 2301, that is, when it is determined that the event to be processed is a note-on event (YES at step 2301), CPU 21 judges at step 2303 whether or not the automatic accompaniment mode has been set to the tetra-chord mode. When it is determined NO at step 2303, CPU 21 performs a normal tone producing process, producing musical tones in accordance with data of melody tones (step 2306). When it is determined YES at step 2303, CPU 21 refers to the tone-producing jins data stored in RAM 23 (step 2304). CPU 21 changes a pitch of the note-on event in accordance with the pitch in the automatic accompaniment data, the tone-producing jins data, and the reference tone (step 2305). The process of step 2305 is performed substantially in a similar manner to the processes performed at steps 2103 and 2105 in FIG. 21.

That is, CPU 21 modifies a pitch of a musical tone to be produced based on the lowest tone in the jins data record and the reference tone. Then, CPU 21 judges whether or not the pitch corresponding to a musical tone in the automatic accompaniment data in the pitches modified in the jins is different from a pitch of white or black key in the normal keyboard. When the pitch corresponding to a musical tone in the automatic accompaniment data is different from a pitch of white or black key in the normal keyboard, CPU 21 modifies the pitch of the musical tone to be produced.

Then, CPU 21 performs the tone producing process to produce the musical tone at the pitch modified at step 2305 (step 2306).

When the automatic accompaniment mode has been set to a mode other than the tetra-chord mode (YES at step 2204), CPU 21 refers to the timer (not shown) to judge whether or not an event-performance timing has been reached with respect to data of a chord tone in the automatic accompaniment data (step 2205). When it is determined YES at step 2205, CPU 21 performs a chord tone producing/deadening process at step 2206. In the chord tone producing/deadening process, a note-on event is created with respect to a chord tone whose tone producing timing has been reached. Meanwhile, a note-off event is created with respect to a chord tone whose tone deadening timing has been reached.

CPU 21 judges at step 2207 whether or not the event-performance timing of the rhythm data in the automatic accompaniment data has been reached. When it is determined YES at step 2207, CPU 21 performs a rhythm tone producing process at step 2208. In the rhythm tone producing process, a note-on event is created with respect to a rhythm tone whose tone producing timing has been reached.

When the automatic accompaniment process finishes at step 805 in FIG. 8, CPU 21 performs the sound-source sound producing process at step 806. In the sound-source sound producing process, based on the created note-on event CPU 21 supplies the sound source 26 with data indicating timbre and a pitch of the musical tone to be produced or data indicating timbre and a pitch of the musical tone to be deadened. The sound source 26 reads waveform data from ROM 22 in accordance with the data indicating timbre, a pitch and a tone duration, creating musical tone data, thereby producing and outputting a predetermined musical tone from the speaker 28.

When the sound-source sound producing process finishes at step 806, CPU 21 performs other processes at step 807, displaying an image of the displaying unit 15, turning on or off LED (not shown), and returns to step 802.

Figure 24:
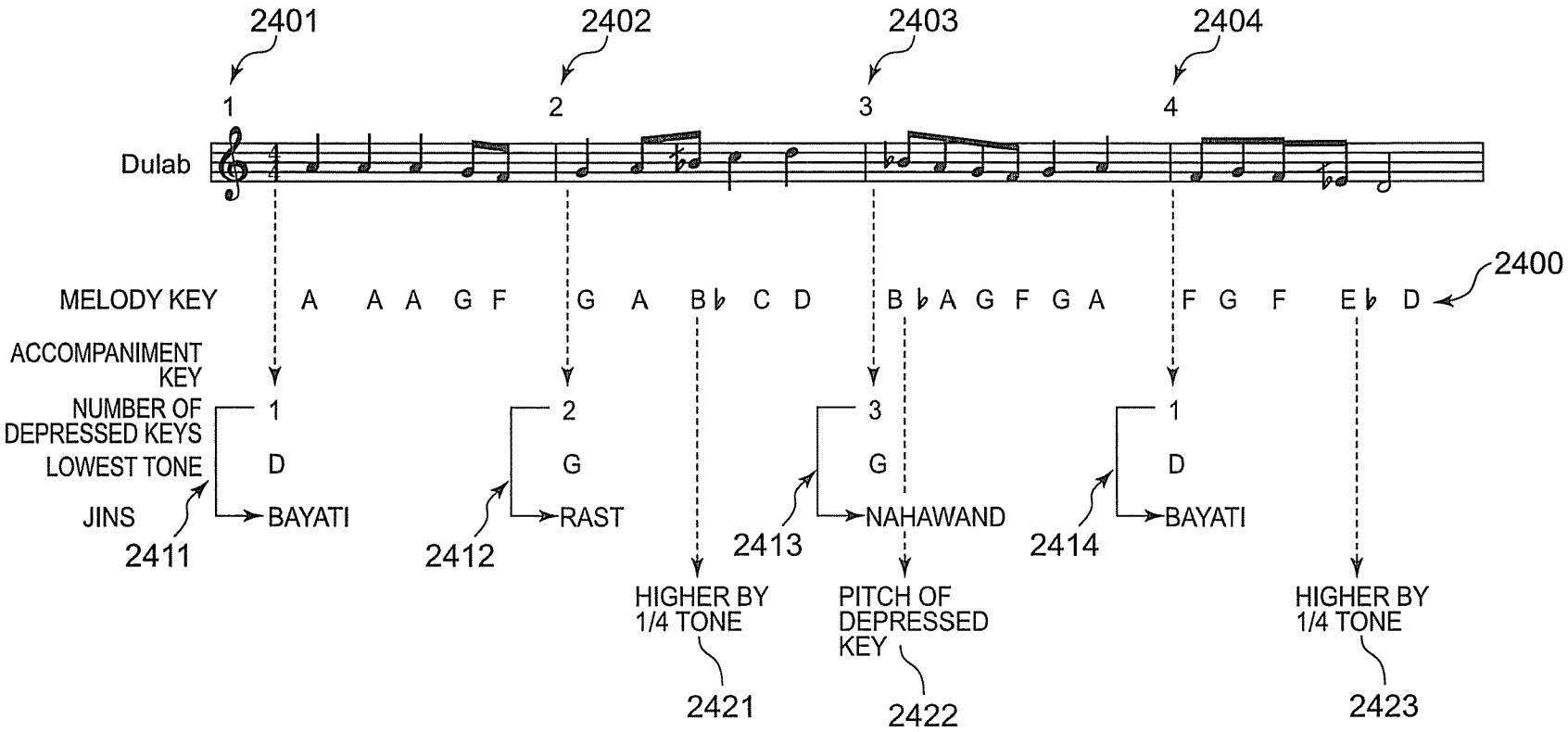
FIG. 24 is a view for explaining depressed keys in the melody-key range, the numbers of depressed keys in the accompaniment-key range and tone names of the lowest tones, and pitches of produced musical tones in the embodiment.

FIG. 24 is a view for explaining depressed keys in the melody-key range 102, the numbers of depressed keys in the accompaniment-key range 101 and tone names of the lowest tones, and pitches of produced musical tones in the embodiment. In FIG. 24, "Maqam Bayati" is selected as the maqam.

In FIG. 24, a key of a tone name (Reference number: 2400) is depressed. At the leading position (Reference number: 2401) of the first measure, a key in the accompaniment-key range 101 is depressed with the lowest tone "D" (the number of depressed keys is "1"). At the leading position (Reference number: 2402) of the second measure, keys in the accompaniment-key range 101 are depressed with the lowest tone "G" (the number of depressed keys is "2"). At the leading position (Reference number: 2403) of the third measure, keys in the accompaniment-key range 101 are depressed with the lowest tone "G" (the number of depressed keys is "3"). At the leading position (Reference number: 2404) of the fourth measure, a key in the accompaniment-key range 101 is depressed with the lowest tone "D" (the number of depressed keys is "1").

In the measures, from the first measure to the fourth measure, shown in FIG. 24, Bayati (Reference number: 2411), Rast (Reference number: 2412), Nahawand (Reference number: 2413), and Bayati (Reference number: 2414) are selected as the ajnas in accordance with the numbers of depressed keys, respectively. Therefore, depressed keys in the melody-key range 102 will be musical notes of pitches conforming to the jins based on the lowest tones of the depressed keys.

For example, in the second measure, the pitches are decided in conformity with Rast with the lowest tone "G", based on the lowest tone "G". The third tone (Reference numeral: 2421) in the second measure produces a musical tone of a pitch higher than a depressed key "B♭" by ¼ tone. In the third measure, pitches are decided in conformity with Nahawand with the lowest tone "G", based on the lowest tone "G". The first tone (Reference numeral: 2422) in the third measure produces a musical tone of the same pitch as the depressed key "B♭". In the fourth measure, the pitches are decided in conformity with Nahawand with the lowest tone "D", based on the lowest tone "D". The fourth tone (Reference numeral: 2423) in the fourth measure produces a musical tone of a pitch higher than a depressed key "B♭" by ¼ tone.

In the present embodiment, CPU 21 decides a pitch of musical tone data, whose tone is to be produced, based on the player's key-depressing operation on the melody-key range 102. With respect to the player's key depressing operation of a key in the melody-key range 102, CPU 21 specifies a jins or a predetermined temperament among the maqam data or the temperament type, in accordance with the key depressed state of keys in the accompaniment-key range 101. CPU 21 specifies composing tones corresponding to depressed keys in the melody-key range, based on composing tones of the specified jins, and gives the sound source 26 an instruction of creating musical tone data of the composing tones. Since the jins is specified among the maqam in accordance with the depressed state of the keys in the accompaniment-key range 102, if the tones composing the specified jins correspond to the depressed keys in the accompaniment-key range and have microtones, musical tones of microtones can be properly created, and if the tones composing the specified jins have pitches corresponding to the normal black and/or white keys, musical tones having pitches corresponding to depressed black and/or white keys can be created.

In the present embodiment, the jins is specified from the maqam data or the temperament-type data based on the number of keys depressed in the accompaniment-key range 101.

Therefore, the player is not required to perform complex manipulation to designate his or her desired jins.

In the present embodiment, CPU 21 refers to the maqan data or the temperament-type data to associate a jins with the number of depressed keys in the order conforming to the temperament type and with duplication eliminated. Therefore, musical tones of pitches can be created in accordance with a different jins by changing the number of depressed keys.

In the present embodiment, CPU 21 modifies a pitch of a tone composing a temperament among the depressed keys in the accompaniment-key range based on a pitch of a predetermined key and the reference tone of the temperament. Therefore, even if a similar melody starts with a different pitch, CPU 21 can create musical tones having proper pitches by changing a key. For example, the player can play the melody starting with a different pitch by setting the lowest tone to a key among the keys depressed in the accompaniment-key range 101 and changing the lowest tone.

In the present embodiment, upon receipt of designation of one of ajnas composing a maqam or a temperament type, CPU 21 displays on the displaying unit 15 the jins data corresponding to the jins, and upon receipt of information indicating pitches modified in the jins data, CPU 21 creates new jins data containing the information indicating the modified pitches. Further, after creating the new jins data, CPU 21 updates the maqam data. Therefore, pitches of the jins composing the maqam can be changed, and the maqam data of the maqam is updated, which contains the jins whose pitches are modifies. Therefore, the pitches of the maqam and the pitches of the jins can be modified as desired by the player.

In the present embodiment, upon receipt of designation of one of ajnas composing the maqam or the temperament type, and further upon receipt of designation of other jins substituting for the designated jins, CPU 21 edits maqam data, including information of designating jins data corresponding to said other jins. Therefore, the jins composing the maqam can be modified as desired by the player.

Although specific embodiments of the present invention have been illustrated in the accompanying drawings and described in the detailed description, it will be understood that the invention is not limited to the particular embodiments described herein, but modifications and variations may be made to the disclosed embodiments while remaining within the scope of the invention as defined by the following claims.

For example, in the present embodiments, musical tones are produced in accordance with the number of depressed keys and the depressed keys and such musical tones follow a jins, wherein the jins is associated with the number of depressed keys in the order conforming to the temperament type of the maqam and with duplication eliminated. But in the present embodiment, the maqam is basically composed of 6 ajnas, and therefore, it will be possible to associate the number "n" of depressed keys with the n-th jins.

What is claimed is:

1. An electronic musical instrument comprising:

storing means for storing temperament data and temperament-type data; and musical-tone data generating means for generating musical-tone data of a predetermined pitch in response to player's manipulation on a manipulating device, wherein the temperament data defines a pitch of a temperament composed of plural composing tones and contains information indicating at least a reference tone of the temperament and pitches of the composing tones of the temperament, and the temperament-type data defines a temperament type composed of a combination of plural temperaments and contains information, which specifies the temperament data for each of the plural temperaments composing the temperament type in the order conforming to the temperament type, the electronic musical instrument, wherein the manipulating device is divided into a first range and a second range and is provided with controlling means for deciding a pitch of a musical tone to be produced, in response to manipulation of a manipulator in the first range of the manipulating device, wherein the controlling means comprises:

temperament deciding means for specifying a temperament from among the temperament-type data based on manipulated manipulators in the second range of the manipulating device with respect to the manipulation of the manipulator in the first range of the manipulating device; and pitch deciding means for specifying a composing tone corresponding to the manipulated manipulator in the first range, from among the composing tones indicated in the temperament specified by the temperament deciding means, and for giving the musical-tone data generating means an instruction of generating musical-tone data having a pitch of the specified composing tone.

2. The electronic musical instrument according to claim 1, wherein, the temperament deciding means specifies a temperament from among the temperament-type data based on the number of manipulated manipulators in the second range of the manipulating device.

3. The electronic musical instrument according to claim 2, wherein, the temperament deciding means refers to the temperament-type data to associate a temperament with the number of manipulated manipulators in the order conforming to the temperament type and with duplication eliminated, thereby specifying the temperament in accordance with the association of the temperament with the number of manipulated manipulators.

4. The electronic musical instrument according to claim 3, wherein, the pitch deciding means modifies a pitch of the composing tone based on a pitch of a specific manipulator among the manipulated manipulators in the second range of the manipulating device and the reference tone, thereby generating musical-tone data having the modified pitch of the composing tone.

5. The electronic musical instrument according to claim 4, wherein, the pitch deciding means sets the pitch of the specific manipulator to a pitch of the manipulator corresponding to the lowest tone among the manipulators manipulated in the second range of the manipulating device.

6. The electronic musical instrument according to claim 5, further comprising:

displaying means for displaying data, wherein the controlling means comprises:

temperament data generating means for receiving designation of a temperament composing the temperament type to display on the displaying means the temperament data corresponding to the designated temperament, and for receiving information indicating a pitch modified in the temperament data to generate new temperament data including the modified pitch; and temperament-type data updating means for updating the temperament-type data after generation of the new temperament data.

7. The electronic musical instrument according to claim 6, wherein the controlling means comprises:

temperament-type data editing means for receiving designation of a temperament composing the temperament type and receiving designation of other temperament to be substituted for by the designated temperament, and for editing the temperament-type data so as to contain information indicating temperament data corresponding to the designated other temperament.

8. A computer readable recording medium to be mounted on an electronic musical instrument, wherein the electronic musical instrument is provided with a computer, storing means for storing temperament data and temperament-type data, and musical-tone data generating means for generating musical-tone data of a predetermined pitch in response to player's manipulation on a manipulating device, which is divided into a first range and a second range, wherein the temperament data defines a pitch of a temperament composed of plural composing tones and contains information indicating at least a reference tone of the temperament and pitches of the composing tones of the temperament, and the temperament-type data defines a temperament type composed of a combination of plural temperaments and contains information, which specifies the temperament data for each of the plural temperaments composing the temperament type in the order conforming to the temperament type, the recording medium storing a musical-tone generating program, when executed, to make the computer perform the steps of:

controlling step of deciding a pitch of a musical tone to be produced, in response to manipulation of a manipulator in the first range of the manipulating device, wherein the controlling step comprises:

temperament deciding step of specifying a temperament from among the temperament-type data based on manipulated manipulators in the second range of the manipulating device with respect to the manipulation of the manipulator in the first range of the manipulating device; and pitch deciding step of specifying a composing tone corresponding to the manipulated manipulator in the first range, from among the composing tones indicated in the temperament specified by the temperament deciding means, and for giving the musical-tone data generating means an instruction of generating musical-tone data having a pitch of the specified composing tone.

* * * * *